US008186179B2

(12) United States Patent
Takahashi et al.

(10) Patent No.: US 8,186,179 B2
(45) Date of Patent: May 29, 2012

(54) EXPANDER-COMPRESSOR UNIT

(75) Inventors: Yasufumi Takahashi, Osaka (JP); Hiroshi Hasegawa, Osaka (JP); Masaru Matsui, Kyoto (JP); Atsuo Okaichi, Osaka (JP); Takeshi Ogata, Osaka (JP)

(73) Assignee: Panasonic Corporation, Osaka (JP)

( * ) Notice: Subject to any disclaimer, the term of this patent is extended or adjusted under 35 U.S.C. 154(b) by 817 days.

(21) Appl. No.: 12/300,701

(22) PCT Filed: Apr. 24, 2007

(86) PCT No.: PCT/JP2007/058871

§ 371 (c)(1),
(2), (4) Date: Nov. 13, 2008

(87) PCT Pub. No.: WO2007/132649

PCT Pub. Date: Nov. 22, 2007

(65) Prior Publication Data

US 2009/0139262 A1 Jun. 4, 2009

(30) Foreign Application Priority Data

May 17, 2006 (JP) ..... 2006-138218

(51) Int. Cl.
*F25B 43/02* (2006.01)

(52) U.S. Cl. ..... 62/468

(58) Field of Classification Search ..... 62/402, 62/468; 418/55.6, 83, 88
See application file for complete search history.

(56) References Cited

U.S. PATENT DOCUMENTS

| | | | |
|---|---|---|---|
| 3,848,702 | A | 11/1974 | Bergman |
| 4,846,640 | A | 7/1989 | Nishida et al. |
| 4,865,530 | A | 9/1989 | Nishida et al. |
| 5,214,932 | A | 6/1993 | Abdelmalek |
| 5,263,822 | A | 11/1993 | Fujio |
| 5,358,392 | A | 10/1994 | Ukai |
| 5,520,526 | A | 5/1996 | Fujio |
| 5,616,019 | A | 4/1997 | Hattori et al. |
| 5,660,539 | A | 8/1997 | Matsunaga et al. |
| 5,775,883 | A | 7/1998 | Hattori et al. |
| 6,098,753 | A | 8/2000 | Lamarre et al. |
| 6,116,877 | A | 9/2000 | Takeuchi et al. |
| 7,628,592 | B2 | 12/2009 | Okamoto et al. |
| 7,717,688 | B2 | 5/2010 | Yoo et al. |
| 7,771,180 | B2 | 8/2010 | Cho et al. |
| 7,896,627 | B2 | 3/2011 | Okamoto et al. |
| 8,033,135 | B2 | 10/2011 | Okaichi et al. |
| 8,087,260 | B2 | 1/2012 | Ogata et al. |
| 2006/0204378 | A1 | 9/2006 | Anderson |
| 2008/0232992 | A1 | 9/2008 | Okamoto et al. |

(Continued)

FOREIGN PATENT DOCUMENTS

| | | |
|---|---|---|
| EP | 1 918 510 | 5/2008 |

(Continued)

*Primary Examiner* — Melvin Jones
(74) *Attorney, Agent, or Firm* — Hamre, Schumann, Mueller & Larson, P.C.

(57) ABSTRACT

An the expander-compressor unit (100) includes a closed casing (1) in which an oil can be stored in its bottom part, a compression mechanism (2) disposed in an upper part of the closed casing (1), an expansion mechanism (3) disposed in a lower part of the closed casing (1), a shaft (5) for coupling the compression mechanism (2) and the an expansion mechanism (3) to each other, and an oil pump (6), disposed between the compression mechanism (2) and the expansion mechanism (3), for supplying the oil (26) filling a surrounding space of the expansion mechanism (3) to the compression mechanism (2).

28 Claims, 18 Drawing Sheets

U.S. PATENT DOCUMENTS

| | | | |
|---|---|---|---|
| 2009/0007590 | A1 | 1/2009 | Sakitani et al. |
| 2009/0139262 | A1 | 6/2009 | Takahashi et al. |
| 2009/0282845 | A1 | 11/2009 | Hasegawa et al. |
| 2010/0003147 | A1 | 1/2010 | Takahashi et al. |
| 2010/0089092 | A1 | 4/2010 | Hasegawa et al. |
| 2010/0107680 | A1 | 5/2010 | Ogata et al. |
| 2010/0132398 | A1 | 6/2010 | Takahashi et al. |
| 2010/0162750 | A1 | 7/2010 | Okaichi et al. |
| 2010/0186439 | A1 | 7/2010 | Ogata et al. |
| 2010/0202909 | A1 | 8/2010 | Shiotani et al. |
| 2010/0254844 | A1 | 10/2010 | Oyagi et al. |
| 2010/0263404 | A1 | 10/2010 | Shiotani et al. |
| 2010/0269536 | A1 | 10/2010 | Wada et al. |
| 2010/0275638 | A1 | 11/2010 | Hasegawa et al. |
| 2011/0138831 | A1 | 6/2011 | Ogata et al. |
| 2011/0302954 | A1 | 12/2011 | Okaichi et al. |

FOREIGN PATENT DOCUMENTS

| | | | |
|---|---|---|---|
| EP | 1 965 022 | | 9/2008 |
| EP | 1 965 022 | A1 | 9/2008 |
| EP | 2 020 483 | | 2/2009 |
| JP | 8-028461 | | 1/1996 |
| JP | 8-028461 | A | 1/1996 |
| JP | 8-082296 | A | 3/1996 |
| JP | 8-086289 | | 4/1996 |
| JP | 9-126171 | | 5/1997 |
| JP | 10-266980 | | 10/1998 |
| JP | 2003-139059 | A | 5/2003 |
| JP | 2005-299632 | A | 10/2005 |
| JP | 2006-132377 | | 5/2006 |
| JP | 2006-283590 | | 10/2006 |
| JP | 2007-315227 | | 12/2007 |
| JP | 2008-008165 | | 1/2008 |
| JP | 2008-215212 | | 9/2008 |
| JP | 2008-240550 | | 10/2008 |
| WO | WO 2007/000854 | | 1/2007 |
| WO | WO 2007/132649 | | 11/2007 |
| WO | WO 2008/087795 | | 7/2008 |

EXPANDER-COMPRESSOR UNIT

TECHNICAL FIELD

The present invention relates to an expander-compressor unit including a compression mechanism for compressing fluid and an expansion mechanism for expanding the fluid, the expander-compressor unit having an integral construction wherein the compression mechanism and the expansion mechanism are coupled to each other by a shaft.

BACKGROUND ART

Recently, as natural resource issues and global warming issues have become ever more serious, much research and development efforts have been invested in reducing energy consumption of heat pump apparatus used for water heaters and air conditioners. For example, conventional heat pump apparatuses have a mechanism of expanding refrigerant using an expansion valve, but there is an attempt to recover the energy of expansion of the refrigerant by employing a positive displacement expander to utilize it as auxiliary power for the compressor. Theoretically, through the recovery and utilization of the expansion energy of the refrigerant, about 20% reduction in power usage can be expected, or even with an actual apparatus about 10% reduction in power usage can be expected. As a fluid machine that realizes such an attempt, development of an expander-compressor unit, such as disclosed in JP 2005-299632 A, is underway at a rapid pace.

FIG. 17 is a vertical cross-sectional view illustrating a typical expander-compressor unit. An expander-compressor unit 200 is provided with a two-stage rotary type compression mechanism 121, a motor 122, a two-stage rotary type expansion mechanism 123, and a closed casing 120 that accommodates them. The compression mechanism 121, the motor 122, and the expansion mechanism 123 are coupled to each other by a shaft 124.

A bottom part of the closed casing 120 forms an oil reservoir 125 for holding oil (refrigeration oil). An oil pump 126 is attached to a lower end portion of the shaft 124 in order to pump up the oil stored in the oil reservoir 125. The oil pumped up by the oil pump 126 is supplied to the compression mechanism 121 and the expansion mechanism 123 via an oil supply passage 127 formed in the shaft 124. Thereby, lubrication and sealing are ensured in the sliding parts of the compression mechanism 121 and the expansion mechanism 123.

An oil return pipe 128 is disposed at an upper part of the expansion mechanism 123. One end of the oil return pipe 128 communicates with the oil supply passage 127 formed in the shaft 124, while the other end opens downward of the expansion mechanism 123. Generally, excess oil is supplied for ensuring the reliability of the expansion mechanism 123. The excess oil is returned via the oil return pipe 128 to the oil reservoir 125.

The expander-compressor unit has the advantage that the compression mechanism and the expansion mechanism can share the same oil easily since the compression mechanism and the expansion mechanism are disposed in a common closed casing.

On the other hand, there is another attempt in which the expansion force of the refrigerant is not directly transferred to the compression mechanism but is used to perform electric power generation, and the generated electric power is input to the motor. According to this attempt, it is unnecessary to integrate the compression mechanism and the expansion mechanism, so the compression mechanism and the expansion mechanism may be accommodated in separate casings.

Although the compression mechanism and the expansion mechanism may be accommodated in separate casings, it is necessary to bear in mind that the oil mixed with the refrigerant circulates in the refrigerant circuit. In other words, some kind of design scheme for balancing the amounts of the oil between the casings is necessary to prevent the amounts of the oil from becoming uneven between the casings so that lubrication deficiency does not occur. On the other hand, such a design scheme is essentially unnecessary for the expander-compressor unit in which the compression mechanism and the expansion mechanism are disposed in a common closed casing.

DISCLOSURE OF THE INVENTION

However, the expander-compressor unit is not without a problem that is associated with oil. As illustrated in FIG. 17, the oil pumped up from the oil reservoir 125 is heated by the compression mechanism 121 because it passes through the compression mechanism 121 that is at a relatively high temperature. The oil heated by the compression mechanism 121 is heated further by the motor 122, and reaches the expansion mechanism 123. The oil that has reached the expansion mechanism 123 is cooled by the expansion mechanism 123 that is at a low temperature, and thereafter discharged downward of the expansion mechanism 123 via the oil return pipe 128. The oil discharged from the expansion mechanism 123 and the oil return pipe 128 is heated again when it passes along a side face of the motor 122. It is also heated when passing along a side face of the compression mechanism 121, and then it returns to the oil reservoir 125 of the closed casing 120.

As described above, since the oil circulates between the compression mechanism and the expansion mechanism, heat transfer occurs from the compression mechanism to the expansion mechanism. Because of such heat transfer, the temperature of the refrigerant discharged from the compression mechanism lowers, while the temperature of the refrigerant discharged from the expansion mechanism rises. In the case of air conditioners, this means a decrease of indoor heating capacity during heating or a decrease of indoor cooling capacity during cooling.

The present invention has been accomplished in view of the foregoing problems, and it is an object of the invention to provide an expander-compressor unit that is improved so that heat transfer from the compression mechanism to the expansion mechanism is suppressed.

Accordingly, the present invention provides an expander-compressor unit including:

a closed casing having a bottom portion utilized as an oil reservoir;

a compression mechanism disposed in the closed casing so as to be located either higher or lower than an oil level of oil held in the oil reservoir;

an expansion mechanism disposed in the closed casing so that its positional relationship to the oil level is vertically opposite to that of the compression mechanism;

a shaft for coupling the compression mechanism and the expansion mechanism to each other; and an oil pump, disposed between the compression mechanism and the expansion mechanism, for supplying the oil filling a surrounding space of the compression mechanism or the expansion mechanism to the compression mechanism or the expansion mechanism that is located higher than the oil level.

In another aspect, the present invention provides an expander-compressor unit including:

a closed casing;

a compression mechanism disposed in the closed casing;

an expansion mechanism disposed in the closed casing;

a shaft for coupling the compression mechanism and the expansion mechanism to each other;

a partition wall, for partitioning an internal space of the closed casing into an upper space in which one selected from the compression mechanism and the expansion mechanism is disposed and a lower space in which the other one is disposed, along an axis direction of the shaft, the partition wall having a communication passage formed therein for allowing the upper space and the lower space to communicate with each other so that the oil held in the closed casing for lubricating the compression mechanism and the expansion mechanism is permitted to travel between the upper space and the lower space; and an oil pump, disposed between the compression mechanism and the expansion mechanism, for pumping up and supplying the oil to one of the compression mechanism and the expansion mechanism that is located in the upper space.

In the former one of the expander-compressor units, the oil pump is disposed between the compression mechanism and the expansion mechanism. Therefore, in a state in which the closed casing is placed upright, the oil supply passage extending toward the mechanism that is positioned above can be formed without passing through the mechanism that is positioned below. Accordingly, the oil pumped up by the oil pump may be supplied to the mechanism positioned above without passing through the mechanism positioned lower than the oil pump. As a result, heat transfer via the oil from the compression mechanism to the expansion mechanism is suppressed.

In the latter one of the expander-compressor units, the oil pump is disposed between the compression mechanism and the expansion mechanism. Therefore, in a state in which the closed casing is placed upright, the oil supply passage extending toward the mechanism that is located in the upper space may be formed without passing through the mechanism that is located in the lower space. Accordingly, the oil pumped up by the oil pump may be supplied to the mechanism that is located in the upper space without passing through the mechanism that is located in the lower space. As a result, heat transfer from the compression mechanism to the expansion mechanism via the oil is suppressed. Moreover, the partition wall restricts travelling of the oil between the upper space and the lower space, and this also serves to suppress the heat transfer. However, the communication passage is formed in the partition wall, and transfer of the oil is permitted between the upper space and the lower space through this communication passage. Therefore, it is unnecessary to take a measure to balance the amount of the oil present in the upper space and the amount of the oil present in the lower space.

BEST MODE FOR CARRYING OUT THE INVENTION (First Embodiment)

Hereinbelow, one embodiment of the present invention is described with reference to the appended drawings.

Figure 1:
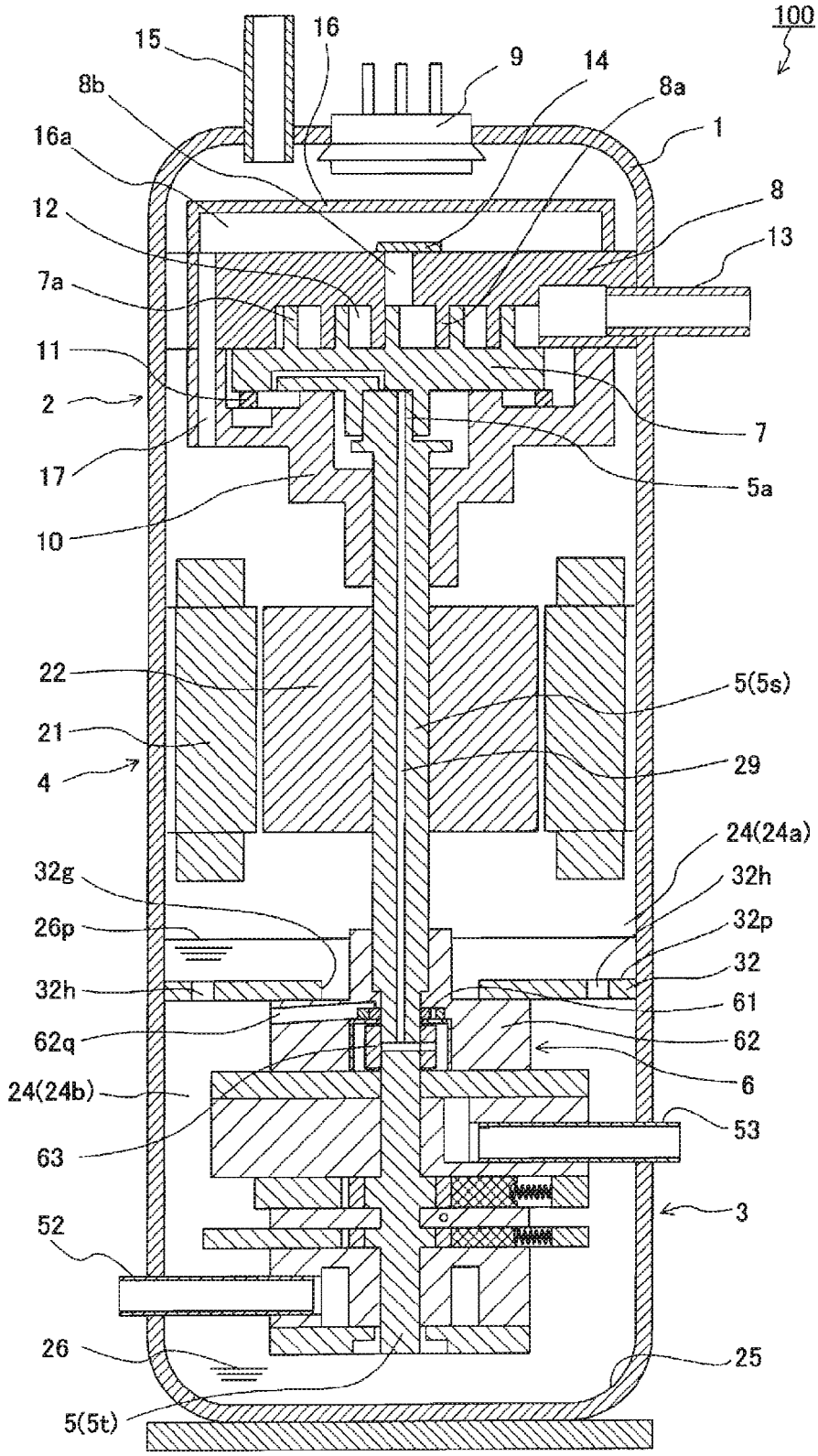
FIG. 1 is a vertical cross-sectional view illustrating an expander-compressor unit according to a first embodiment of the present invention.

FIG. 1 is a vertical cross-sectional view illustrating an expander-compressor unit according to a first embodiment of the present invention. An expander-compressor unit 100 includes: a closed casing 1 having an internal space 24; a scroll-type compression mechanism 2 disposed above the internal space 24; a two-stage rotary type expansion mechanism 3 disposed below the internal space 24; a motor 4 disposed between the compression mechanism 2 and the expansion mechanism 3; an oil pump 6 disposed between the motor 4 and the expansion mechanism 3; a partition wall 32 disposed between the oil pump 6 and the motor 4; and a shaft 5 for coupling the compression mechanism 2, the expansion mechanism 3, and the motor 4 to each other. The motor 4 rotationally drives the shaft 5, whereby the compression mechanism 2 is operated. The expansion mechanism 3 converts the expansion force of the working fluid (refrigerant) under expansion into torque, and gives it to the shaft 5 to assist the rotational driving of the shaft 5 by the motor 4. High energy recovery efficiency is expected from this mechanism, in which the energy of expansion of the refrigerant is not provisionally converted into electric energy but is transferred directly to the compression mechanism 2.

It should be noted that it is assumed the expander-compressor unit 100 of the present embodiment is used in a condition in which the closed casing 1 is placed upright. Accordingly, the direction parallel to an axis direction of the shaft 5 is regarded as the vertical direction, and the portion in which the compression mechanism 2 is disposed is regarded as an upper part while the portion in which the expansion mechanism 3 is disposed is regarded as a lower part. The positions of the compression mechanism 2 and the expansion mechanism 3, however, may be opposite to those in the present embodiment. Specifically, it is possible to employ an embodiment in which the compression mechanism 2 is located in the lower part while the expansion mechanism 3 is located in the upper part. In addition, although the scroll-type compression mechanism 2 and the rotary type expansion mechanism 3 are employed in the present embodiment, the types of the mechanisms are not limited to them. For example, it is possible that both the compression mechanism and the expansion mechanism may be of a rotary type or of a scroll-type. Further, it is conceivable to employ a reciprocating-type mechanism.

A bottom part of the closed casing 1 forms an oil reservoir 25 for holding oil 26. The oil 26 is used for ensuring lubrication and sealing of the sliding parts of the compression mechanism 2 and the expansion mechanism 3. The amount of the oil 26 held in the oil reservoir 25 is adjusted to be within a range such that an oil level 26*p* is located higher than the partition wall 32 in a state in which the closed casing 1 is placed upright, i.e., in a state in which the posture of the closed casing 1 is determined so that the axis direction of the shaft 5 is parallel to the vertical direction. More specifically, the amount of the oil 26 is adjusted to be within a range such that a surrounding space of the expansion mechanism 3 is filled with the oil 26 and that the compression mechanism 2 and the motor 4 are located higher than the oil level 26*p*. When the amount of the oil 26 is adjusted to be within such a range that the compression mechanism 2 and the motor 4 are not immersed in the oil 26, the direct heat transfer from the compression mechanism 2 and the motor 4 to the oil 26 can be prevented during the operation of the heat pump apparatus that employs the expander-compressor unit 100. In addition, it is possible to prevent the decrease in motor efficiency and the increase in the amount of oil discharged to the refrigerant circuit, which result from the stirring of the oil 26 held in the oil reservoir 25 by a rotor 22 of the motor 4. It is particularly desirable that the rotor 22 of the motor 4 be away from the oil level 26*p*. With such a configuration, the oil 26 does not increase the load of the motor 4.

The oil pump 6 pumps up and supplies the oil 26, in which the expansion mechanism 3 is immersed, to the compression mechanism 2. An oil supply passage 29 that is in communication with the sliding parts of the compression mechanism 2, which is located higher than the oil level 26*p*, is formed inside the shaft 5 so as to extend in the axis direction. The oil 26 discharged from the oil pump 6 is fed into the oil supply passage 29 and supplied to the sliding parts of the compression mechanism 2 without passing through the expansion mechanism 3. With such a configuration, heat transfer from the compression mechanism 2 to the expansion mechanism 3 via the oil 26 can be suppressed because the oil 26 travelling toward the compression mechanism 2 is not cooled at the expansion mechanism 3. Moreover, formation of the oil supply passage 29 inside the shaft 5 is desirable because an increase in the parts count and the problem of layout of the parts do not arise additionally.

The partition wall 32 has a circular plate-like shape in which a first through hole 32*g* for allowing the shaft 5 to penetrate therethrough is opened at its center. The partition wall 32 partitions the internal space 24 of the closed casing 1 into an upper space 24*a* in which the compression mechanism 2 is disposed together with the motor 4, and a lower space 24*b* in which the expansion mechanism 3 is disposed together with the oil pump 6, along the axis direction of the shaft 5. The partition wall 32 serves to restrict travelling of the oil 26 between the upper space 24*a* and the lower space 24*b*. As seen from the half section perspective view of FIG. 3, the partition wall 32 has such a shape that its outer circumference portion fixed to the closed casing 1 with fastening parts such as screws or bolts forms a part of the closed casing 1. In addition, the oil pump 6 is fixed to an inner-peripheral portion of the partition wall 32 around the opening of the first through hole 32*g* with screws or bolts, and the first through hole 32*g* is closed from below by the oil pump 6. In other words, the oil pump 6 and the expansion mechanism 3 are positioned in the closed casing 1 in such a configuration that they hang from the partition wall 32. In addition, second through holes 32*h* are formed in the partition wall 32, each serving as a communication passage for allowing the upper space 24*a* and the lower space 24*b* to communicate with each other so that the oil 26 is permitted to travel between the upper space 24*a* and the lower space 24*b*. The second through holes 32*h* are smaller than the first through hole 32*g* that is at the center, and they are formed at a plurality of locations around the shaft 5 at equal angular intervals.

By restricting travelling of the oil 26 between the upper space 24*a* and the lower space 24*b*, the partition wall 32 has the effect of heat insulation between the upper space 24*a* and the lower space 24*b* and the effect of obstructing the flow of the oil 26. Because of the thermal insulation effect and the flow obstruction effect by the partition wall 32, the oil 26 held in the closed casing 1 is provided with a temperature gradient along the axis direction of the shaft 5. That is, it becomes possible to intentionally produce a suitable condition for a refrigeration cycle, in which the oil 26 drawn by the oil pump 6 to be supplied to the compression mechanism 2 is at a relatively high temperature while the oil 26 remaining in a surrounding space of the expansion mechanism 3 is at a relatively low temperature.

During the time that the heat pump apparatus employing the expander-compressor unit 100 of the present embodiment is being stopped or in a normal operation, the oil level 26*p* is located higher than an upper face 32*p* of the partition wall 32. Upon starting the operation of the heat pump apparatus, the oil level 26*p* is in a violently wavy condition from the influence of the swirling flow caused by the motor 4. If the rotor 22 of the motor 4 is immersed in the oil 26, the thermal insulation effect and the flow obstruction effect of the partition wall 32 will be reduced by half because the oil 26 is stirred directly by the rotor 22. In that sense as well, it is preferable that the rotor 22 of the motor 4 be spaced from the oil level 26*p* as far as possible, as long as the dimensions of the closed casing 1 do not increase considerably.

Examples of the materials for constituting the partition wall 32 include metals, plastics, and ceramics. Since the closed casing 1 is usually made of metal, it is preferable that the partition wall 32 be also made of the same metal material as the material for the closed casing 1. It is also possible, however, to form a surface film having a smaller thermal conductivity than the material for the partition wall 32, such as a plastic film, on the upper face 32*p*, or to perform a surface treatment, such as provision of a surface roughness, for the upper face 32*p*, for the purposes of improving the heat insulation performance and reducing turbulence of the oil level 26*p*.

It should be noted that whether or not the partition wall 32 is provided does not affect the configuration in which the oil pump 6 is disposed between the compression mechanism 2 and the expansion mechanism 3 and the oil 26 is supplied to the compression mechanism 2 by the oil pump 6 without passing through the expansion mechanism 3. The effect of suppressing heat transfer via the oil 26 is obtained as long as the oil 26 drawn in and discharged by the oil pump 6 is supplied to the compression mechanism 2 without passing through the expansion mechanism 3.

Next, the compression mechanism 2 and the expansion mechanism 3 will be briefly described below.

The scroll type compressor mechanism 2 has an orbiting scroll 7, a stationary scroll 8, an Oldham ring 11, a bearing member 10, a muffler 16, a suction pipe 13, and a discharge pipe 15. The orbiting scroll 7 is fitted to an eccentric portion 5*a* of the shaft 5, and its self-rotation is restrained by the Oldham ring 11. The orbiting scroll 7, with its spiral shaped lap 7*a* meshing with a lap 8*a* of the stationary scroll 8, scrolls in association with rotation of the shaft 5. A crescent-shaped working chamber 12 formed between the laps 7*a* and 8*a* reduces its volumetric capacity as it moves from outside to inside, and thereby, it compresses the working fluid drawn in the suction pipe 13. The compressed working fluid presses and opens a lead valve 14 and passes through a discharge port 8*b* formed at the center of the stationary scroll 8, an internal space 16*a* of the muffler 16, and a flow passage 17 penetrating through the stationary scroll 8 and the bearing member 10, in that order. The working fluid then is discharged to an internal space 24*a* of the closed casing 1. The oil 26 that has reached the compression mechanism 2 via the oil supply passage 29 of the shaft 5 lubricates the sliding surfaces between the orbiting scroll 7 and the eccentric shaft 5*a* and the sliding surfaces between the orbiting scroll 7 and the stationary scroll 8. The working fluid that has been discharged in the internal space 24 of the closed casing 1 is separated from the oil 26 by a gravitational force or a centrifugal force while it is staying in the internal space 24. Thereafter, the working fluid is discharged from the discharge pipe 15 to a gas cooler.

The motor 4 for driving the compression mechanism 2 via the shaft 5 includes a stator 21 fixed to the closed casing 1 and a rotor 22 fixed to the shaft 5. Electric power is supplied from a terminal 9 disposed at the top of the closed casing 1 to the motor 4. The motor 4 may be either a synchronous machine or an induction machine. It is cooled by the working fluid and the oil 26 discharged from the compression mechanism 2.

The shaft 5 is constituted by a compression mechanism-side shaft 5*s* connected to the compression mechanism 2 and an expansion mechanism-side shaft 5*t* connected to the expansion mechanism 3. The compression mechanism-side shaft 5*s* and the expansion mechanism-side shaft 5*t* are coupled by a coupler 63 so that they rotate in synchronization with each other. When using a plurality of separate components, like the compression mechanism-side shaft 5*s* and the expansion mechanism-side shaft 5*t*, as a single piece, a slight margin forms at the coupling portion between the shafts 5*s* and 5*t*. In the case where there is such a margin, the two mechanisms 2 and 3 can be driven smoothly, and noise and vibration are reduced, even when the center of rotation of the compression mechanism 2 and the center of rotation of the expansion mechanism 3 are deviated slightly from each other. Of course, it is possible to use a single shaft.

Figure 2:
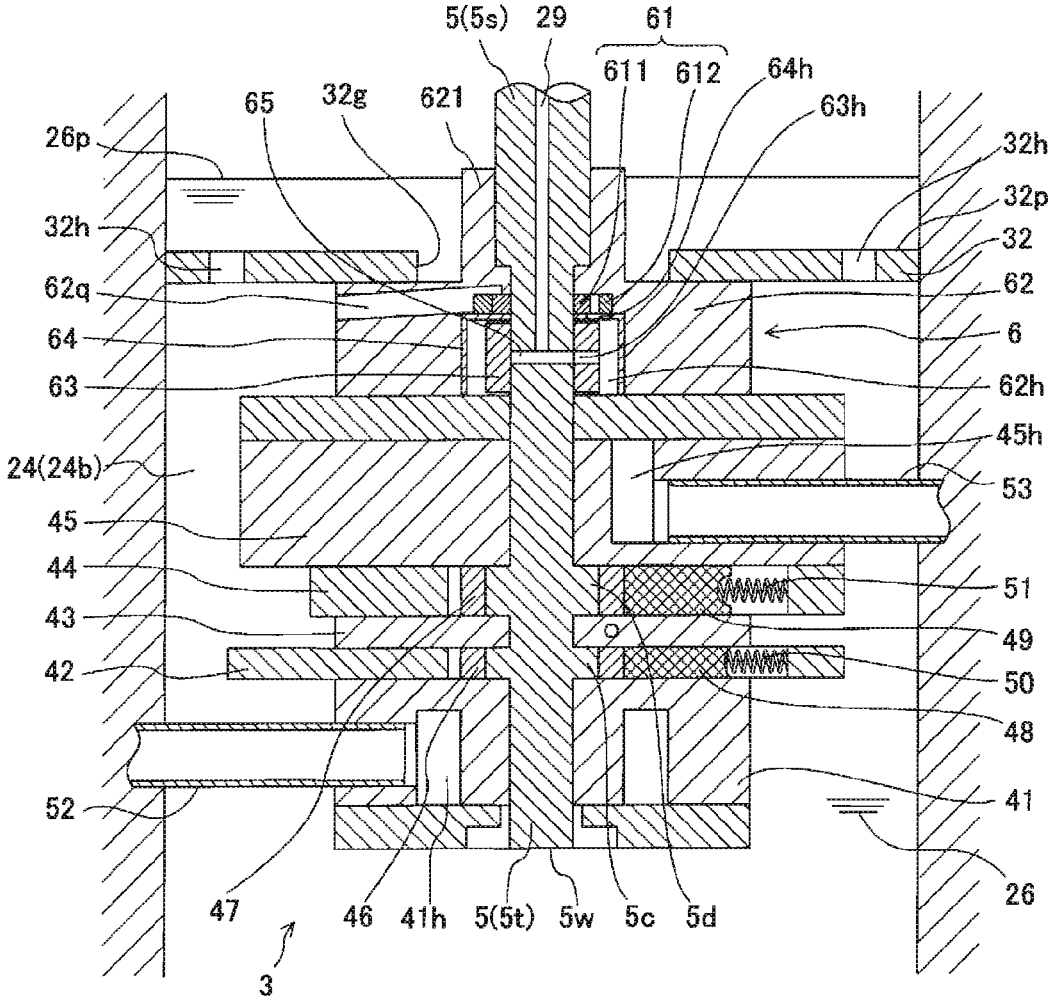
FIG. 2 is a partially enlarged cross-sectional view of the expander-compressor unit of FIG. 1.
Figure 3:
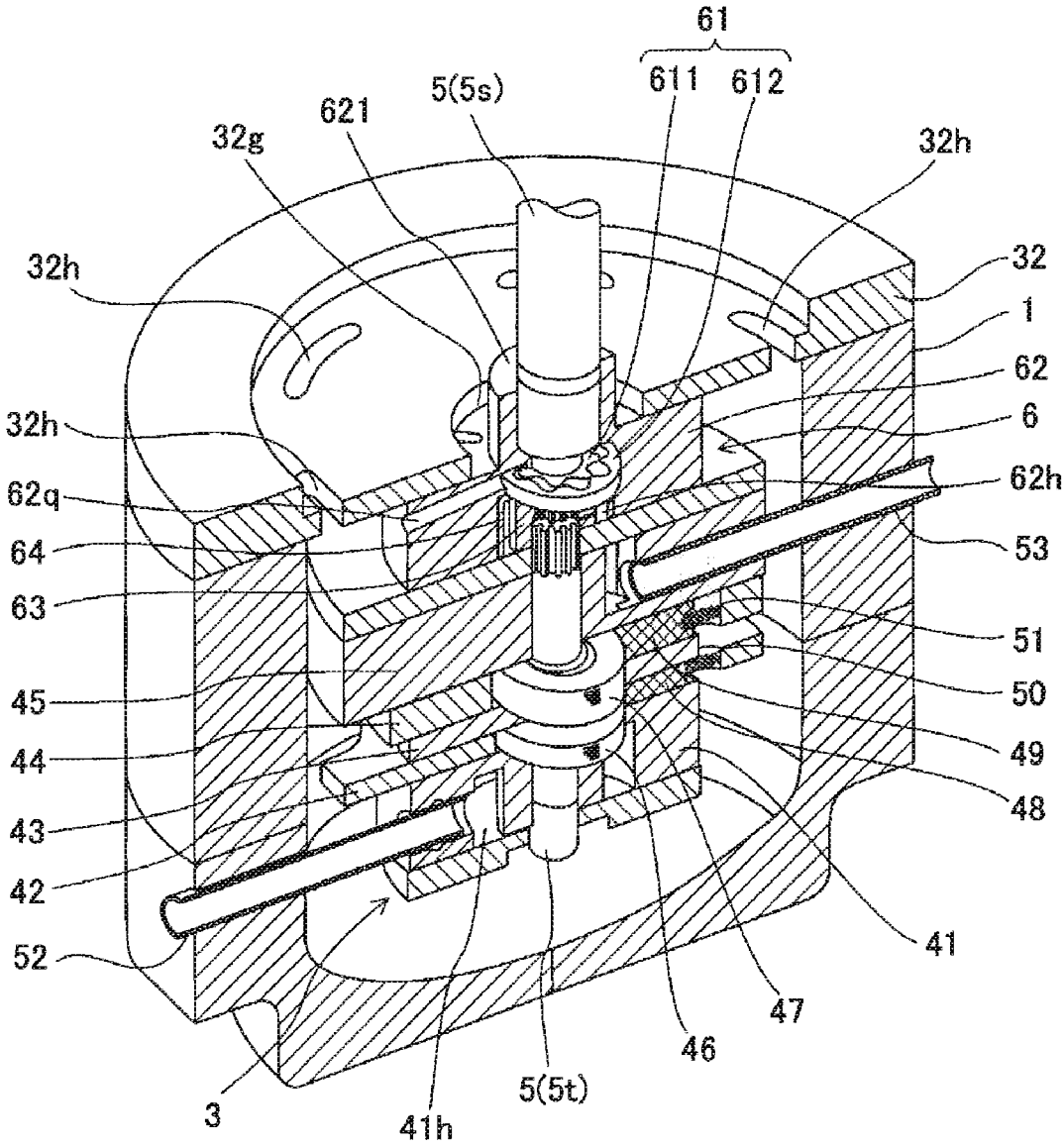
FIG. 3 is a half section perspective view illustrating the expander-compressor unit of FIG. 1.

FIG. 2 shows a partially enlarged cross-sectional view of the expander-compressor unit, and FIG. 3 shows a half section perspective view thereof. As illustrated in FIGS. 2 and 3, the two-stage rotary type expansion mechanism 3 includes a lower bearing member 41, a first cylinder 42, an intermediate plate 43, a second cylinder 44, an upper bearing member 45, a first roller (first piston) 46, a second roller (second piston) 47, a first vane 48, a second vane 49, a first spring 50, and a second spring 51.

The first cylinder 42 is fixed to an upper part of the lower bearing member 41, which supports the shaft 5. The intermediate plate 43 is fixed to an upper part of the first cylinder 42, and the second cylinder 44 is fixed to an upper part of the intermediate plate 43. The first roller 46 is disposed in the first cylinder 42 and is fitted rotatably to a first eccentric portion 5*c* of the shaft 5. The second roller 47 is disposed in the second cylinder 44 and is fitted rotatably to a second eccentric portion 5*d* of the shaft 5. The first vane 48 is disposed slidably in a vane groove formed in the first cylinder 42. The second vane 49 is disposed slidably in a vane groove of the second cylinder 44. The first vane 48 is pressed against the first roller 46 by the first spring 50. It partitions the space between the first cylinder 42 and the first roller 46 into a suction side space and a discharge side space. The second vane 49 is pressed against the second roller 47 by the second spring 51. It partitions the space between the second cylinder 44 and the second roller 47 into a suction side space and a discharge side space. A communication port is formed in the intermediate plate 43. The communication port allows the discharge side space of the first cylinder 42 and the suction side space of the second cylinder 44 to communicate with each other, so as to form an expansion chamber by the two spaces.

The working fluid drawn from a suction pipe 52 to the expansion mechanism 3 is guided to the suction side space of the first cylinder 42 via a communication passage 41*h* formed in the lower bearing member 41. As the shaft 5 rotates, the suction side space of the first cylinder 42 is moved out of communication with the communication passage 41*h* of the lower bearing member 41 and is changed into a discharge side space. As the shaft 5 rotates further, the working fluid that has moved to the discharge side space of the first cylinder 42 is guided to the suction side space of the second cylinder 44 via the communication port of the intermediate plate 43. As the shaft 5 rotates further, the volumetric capacity of the suction side space of the second cylinder 44 increases, while the volumetric capacity of the discharge side space of the first cylinder 42 decreases. The working fluid expands because the amount of the increase in volumetric capacity of the suction side space of the second cylinder 44 is greater than the amount of the decrease in volumetric capacity of the discharge side space of the first cylinder 42. At this time, the expansion force of the working fluid is applied to the shaft 5, so the load to the motor 4 is reduced. As the shaft 5 rotates further, the discharge side space of the first cylinder 42 and the suction side space of the second cylinder 44 are moved out of communication with each other, and the suction side space of the second cylinder 44 is changed into a discharge side space. The working fluid that has moved to the discharge side space of the second cylinder 44 is discharged from a discharge pipe 53 via a communication passage 45*h* formed in the upper bearing member 45.

Figure 6A:
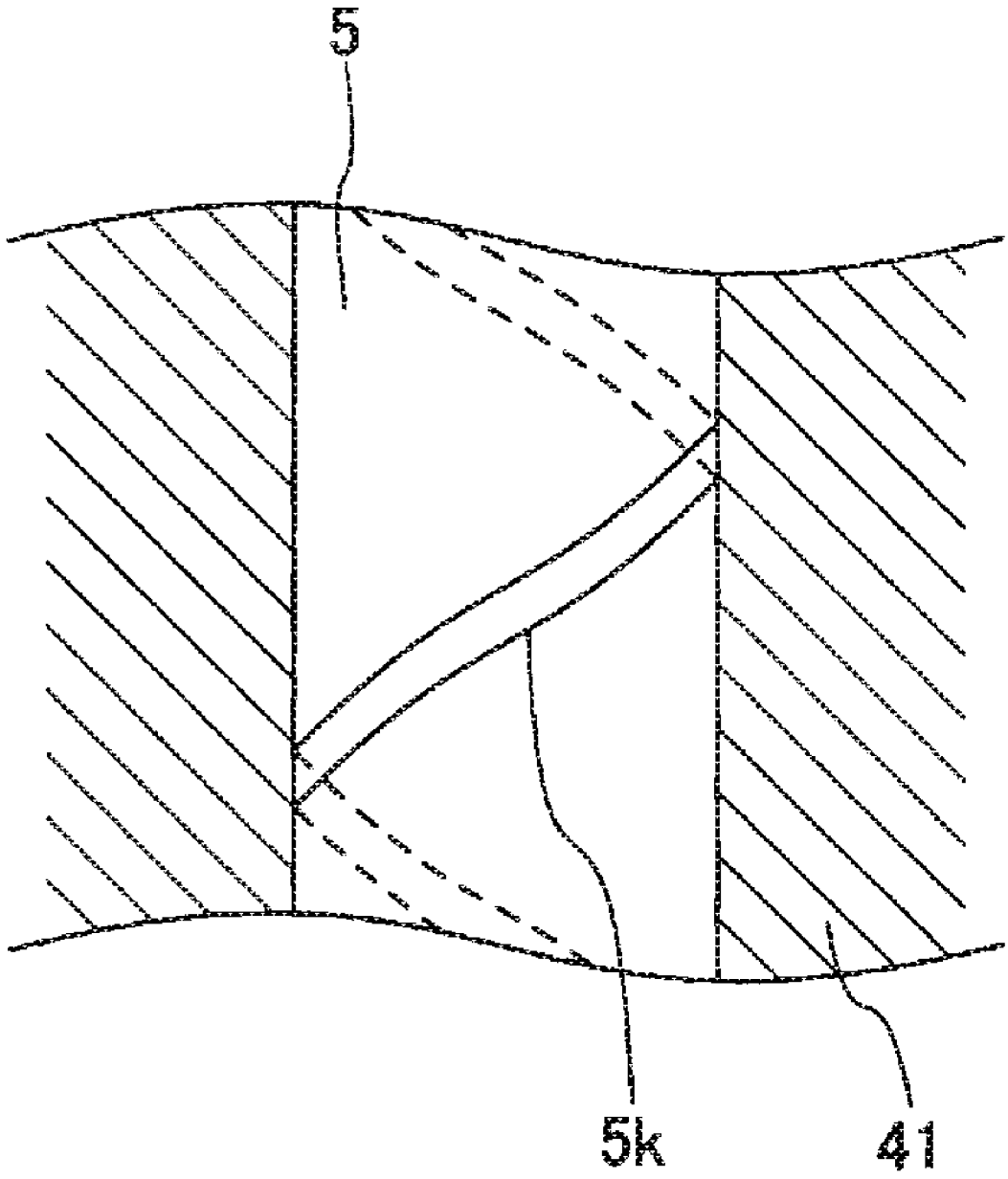
FIG. 6A is a schematic view illustrating a groove formed in the outer circumferential surface of a shaft.

When a rotary type mechanism is used for one of the compression mechanism 2 and the expansion mechanism 3 that is disposed in the lower space 24*b* and whose surrounding space is filled with the oil 26, the shaft 5 (the expansion mechanism-side shaft 5*t* in the present embodiment) penetrates the rotary type mechanism in an axis direction. Therefore, it is possible to employ a structure in which a lower end portion 5*w* of the shaft 5 is directly in contact with the oil 26. In this case, as illustrated in FIG. 6A, the expansion mechanism 3 can be lubricated by forming, in the outer circumferential surface of the shaft 5, a groove 5*k* extending from the lower end portion 5*w* toward the cylinders 42 and 44 of the expansion mechanism 3. The pressure applied to the oil 26 that is being stored in the oil reservoir 25 is greater than the pressure applied to the oil 26 that is lubricating the cylinders 42, 44 and the pistons 46, 47. The oil 26 that is being stored in the oil reservoir 25 can be flowed through the groove 5*k* and supplied to the cylinders 42 and 44 of the expansion mechanism 3 without the aid of an oil pump.

Figure 6B:
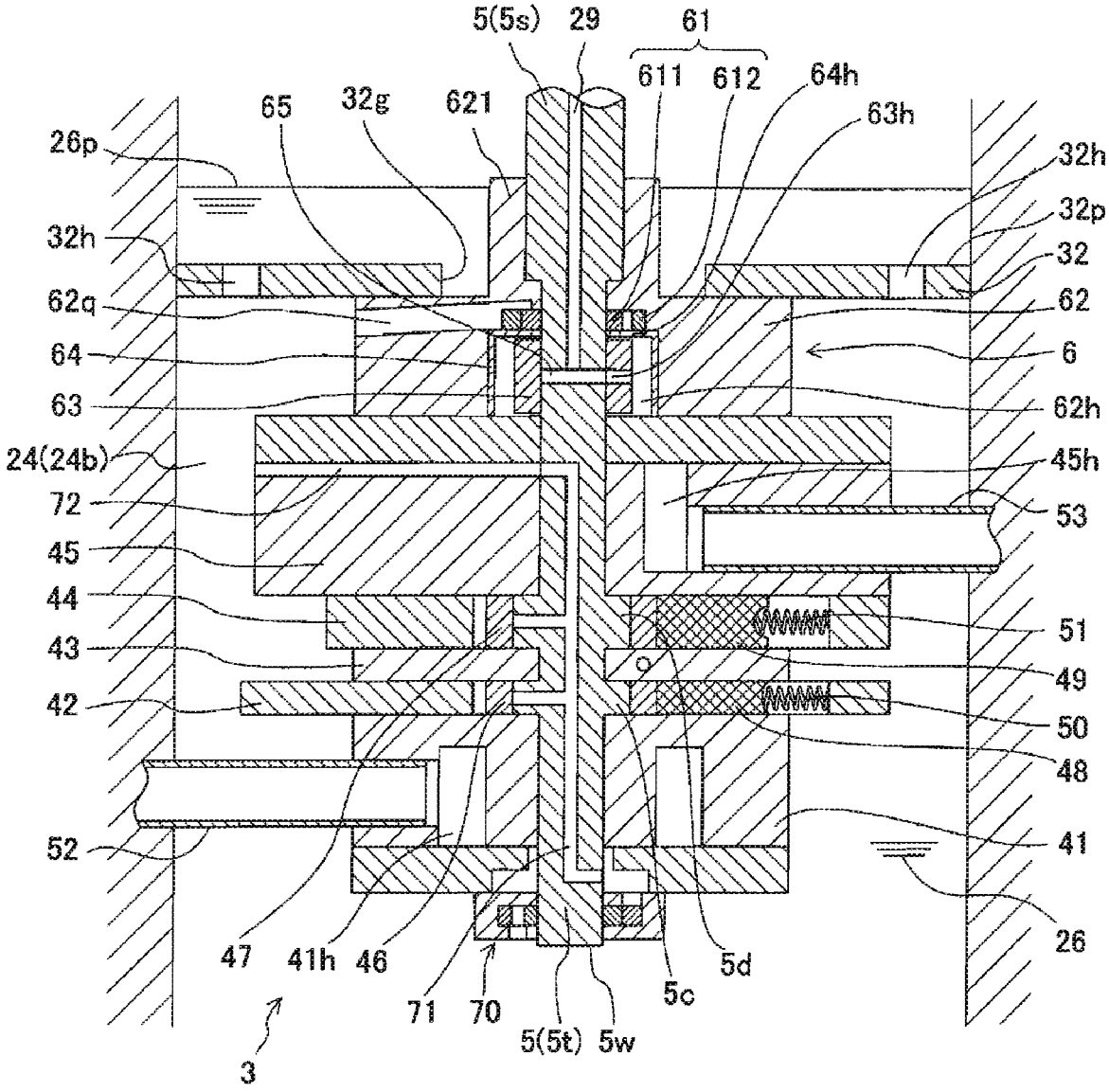
FIG. 6B is a partially enlarged cross-sectional view illustrating a modified example of the expander-compressor unit.

Of course, as illustrated in FIG. 6B, it is possible to attach a second oil pump 70 to the lower end portion 5*w* of the expansion mechanism-side shaft 5*t* and supply the oil 26 to the sliding parts of the expansion mechanism 3 using the second oil pump 70. In the example shown in FIG. 6B, a second oil supply passage 71 extending toward the cylinders 42 and 44 of the expansion mechanism 3 is formed inside the expansion mechanism-side shaft 5*t*. The oil 26 discharged from the second oil pump 70 is supplied to the sliding parts of the expansion mechanism 3 through the second oil supply passage 71. The second oil supply passage 71 communicates with an oil release groove 72 formed in the upper bearing member 45. The excess oil 26 that is discharged from the second oil pump 70 is returned to the oil reservoir 25 through this oil release groove 72. Such a configuration makes it possible to circumvent the circulation of the oil 26 between the compression mechanism 2 and the expansion mechanism 3. An oil pump similar to the oil pump 6 may be used suitably as the second oil pump 70.

In a rotary type mechanism (a compression mechanism or an expansion mechanism), it is necessary to lubricate a vane that partitions a space in the cylinder into two spaces due to its structural limitations. However, when the entire mechanism is immersed in the oil 26, the vane can be lubricated in a remarkably simple manner, specifically, by exposing a rear end of the vane groove in which the vane is disposed, to the interior of the closed casing 1. In the present embodiment as well, the vanes 48 and 49 are lubricated in such a manner.

Incidentally, lubrication of the vanes is somewhat difficult when at least one of the compression mechanism and the expansion mechanism employs a rotary type mechanism and the rotary type mechanism employs a layout in which the mechanism is not immersed in oil. First, among the components of the rotary type mechanism that require lubrication, the pistons and the cylinders can be lubricated relatively easily by using the oil supply passage formed in the shaft. However, this is not the case with the vanes. Since the vanes are considerably away from the shaft, it is impossible to supply oil directly from the oil supply passage in the shaft to the vane grooves. For this reason, some kind of design scheme is necessary for sending the oil discharged from the upper end portion of the shaft to the vane grooves. Such a design scheme may be, for example, provision of an oil supply pipe outside the cylinders separately, but it inevitably necessitates an increase of the parts count and complications of the structure.

On the other hand, such a design scheme is essentially unnecessary in the case of a scroll-type mechanism, in which it is possible to distribute oil to all the parts requiring lubrication relatively easily. In view of such circumstances, it can be said that the layout in which the rotary type mechanism is immersed in oil and the scroll-type mechanism is located higher than the oil level is one of the most desirable layouts. In order to realize such a layout, the present embodiment employs the following configuration. The compression mechanism 2 and the expansion mechanism 3 are a scroll-type mechanism and a rotary type mechanism, respectively, and the compression mechanism 2, the motor 4, the oil pump 6, and the expansion mechanism 3 are disposed in that order along the axis direction of the shaft 5 so that the rotary type expansion mechanism 3 can be immersed directly in the oil 26.

Next, the oil pump 6 will be described in detail. As illustrated in FIGS. 2 and 3, the oil pump 6 is constituted by a pump main unit 61 and a pump housing 62. The pump main unit 61 is configured to pump the oil 26 by an increase or decrease of the volumetric capacity of the working chamber that is associated with rotation of the shaft 5. The pump housing 62 is disposed adjacent to the pump main unit 61. The pump housing 62 supports the pump main unit 61 rotatably and has an oil chamber 62*h* therein that accommodates the oil 26 discharged from the pump main unit 61 temporarily. A portion of the shaft 5 is exposed in the oil chamber 62*h*, thereby to form a structure in which the oil 26 discharged from the pump main unit 61 is fed into the oil supply passage 29 formed inside the shaft 5. By allowing the shaft 5 to pass through the oil pump 6 in this way, the oil 26 can be sent into the oil supply passage 29 with no leakage without providing a separate oil supply pipe.

Figure 4:
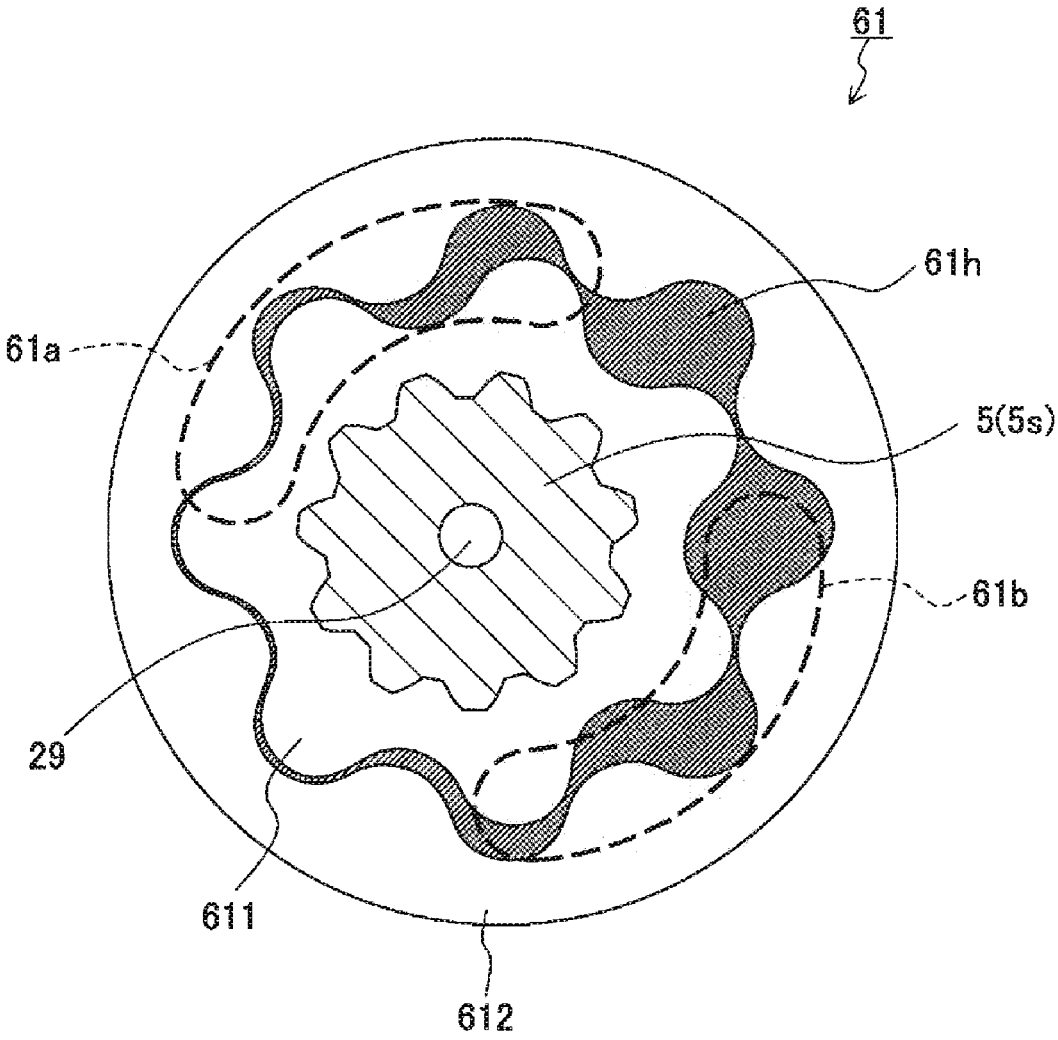
FIG. 4 is a plan view illustrating a pump main unit.

The type of the oil pump 6 is not particularly limited. The present embodiment employs, as illustrated in FIG. 4, an oil pump containing a rotary type pump main unit 61 having an inner rotor 611 that is attached to the shaft 5 and an outer rotor 612 that forms a working chamber 61*h* between it and the inner rotor 611. This oil pump 6 is what is called a Trochoid pump (a registered trademark of Nippon Oil Pump Co., Ltd.). The center of the inner rotor 611 and the center of the outer rotor 612 are deviated from each other, and the number of gear teeth of the inner rotor 611 is smaller than that of the outer rotor 612. Therefore, the volumetric capacity of the working chamber 61*h* increases/decreases in accordance with rotation of the shaft 5. Because of this volumetric capacity change, the oil 26 is drawn from a suction port 61*a* into the working chamber 61*h* and is then discharged from a discharge port 61*b*. Such a rotary type oil pump 6 does not convert the rotational motion of the shaft 5 into another motion by a cam mechanism or the like but directly utilizes it as the motion for pumping the oil 26. Therefore, it has the advantage that the mechanical loss is small. Moreover, it is highly reliable since it has a relatively simple structure.

As illustrated in FIG. 2, the pump housing 62 includes an inner wall portion 64 that partitions an internal space of the pump housing 62 into the oil chamber 62*h* and a space in which the pump main unit 61 is disposed, along the axis direction of the shaft 5. In the present embodiment, the pump main unit 61 is disposed in the space above the inner wall portion 64, and the pump main unit 61 is supported directly by the inner wall portion 64. A communication port 64*h* is formed in the inner wall portion 64. One end of the communication port forms the discharge port 61*b* (see FIG. 4) of the pump main unit 61 and the other end of the communication port opens in the oil chamber 62*h*. With such a configuration in which the pump main unit 61 and the oil chamber 62*h* are adjacent to each other, the oil 26 discharged from the pump main unit 61 flows through the communication port 64*h* smoothly and travels to the oil chamber 62*h*.

In addition, an oil suction passage 62*q*, one end of which forms the suction port 61*a* of the pump main unit 61 and the other end of which opens in the lower space 24*b* of the closed casing 1, is formed in the pump housing 62, so as to extend from the outer circumferential surface of the pump housing 62 toward the space in which the pump main unit 61 is accommodated. Since the oil suction passage 62*q* opens in the lower space 24*b*, the oil 26 can be drawn into the pump main unit 61 stably even when the oil level 26*p* lowers temporarily.

Figure 5:
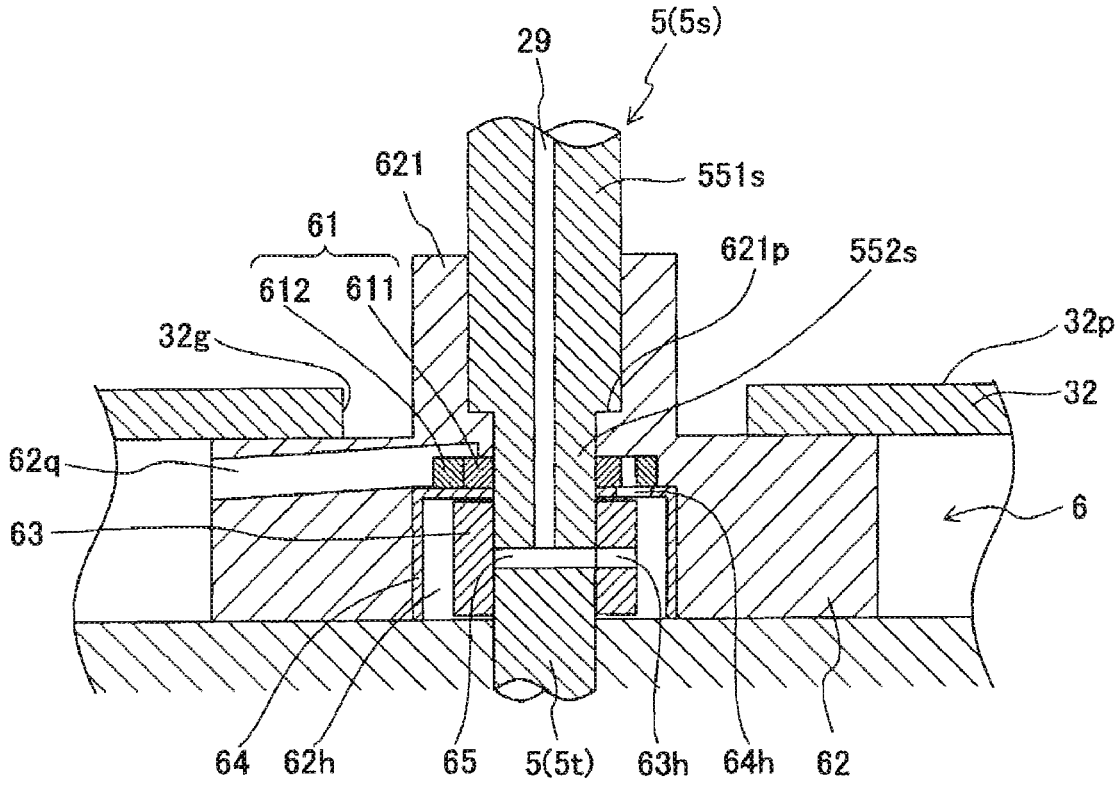
FIG. 5 is an enlarged cross-sectional view illustrating an oil pump and its surrounding space.

Moreover, the oil chamber 62*h* of the pump housing 62 is closed by an end plate 45 that also serves as the upper bearing member of the expansion mechanism 3. On the other hand, the pump housing 62 has a bearing portion 621 that bears a thrust load of the compression mechanism-side shaft 5*s*, in its upper side opposite to the oil chamber 62*h* across the pump main unit 61. As illustrated in FIG. 5, the bearing portion 621 penetrates the first through hole 32*g* and protrudes above the upper face 32*p* of the partition wall 32. A portion of the compression mechanism-side shaft 5*s* that is inserted from the bearing portion 621 into the pump housing 62 includes a larger diameter portion 551*s* that is located upward and close to the motor 4, and a smaller diameter portion 552*s* to which the pump main unit 61 is attached. The larger diameter portion 551*s* is seated on a staged surface (thrust surface) 621*p* of the bearing portion 621 of the pump housing 62. Such a bearing structure makes possible the smooth rotation of the compression mechanism-side shaft 5*s*.

The compression mechanism-side shaft 5*s* and the expansion mechanism-side shaft 5*t*, which are comprised of two shafts (or a plurality of shafts), are coupled to each other in the oil chamber 62*h* of the pump housing 62. Such a configuration makes it possible to guide the oil 26 discharged from the pump main unit 61 to the oil supply passage 29 formed inside the compression mechanism-side shaft 5*s* easily.

Specifically, in the present embodiment, the compression mechanism-side shaft 5*s* and the expansion mechanism-side shaft 5*t* are coupled to each other using a coupler 63. This coupler 63 is disposed in the oil chamber 62*h* of the pump housing 62. In this way, the oil chamber 62*h* of the pump housing 62 serves both the role of connecting the pump main unit 61 and the compression mechanism-side shaft 5*s* and the role of providing an installation space for the coupler 63. As illustrated in FIG. 3, gear teeth for coupling are formed on the outer circumferential surfaces of the compression mechanism-side shaft 5*s* and the expansion mechanism-side shaft 5*t*. The gear teeth are fitted to the coupler 63, and thereby the two shafts are coupled to each other. The torque of the expansion mechanism-side shaft 5*t* is transferred to the compression mechanism-side shaft 5*s* via the coupler 63.

When the compression mechanism-side shaft 5*s* and the expansion mechanism-side shaft 5*t* are coupled to each other by the coupler 63, a problem is how to ensure a passage for feeding the oil 26 discharged from the pump main unit 61 into the oil supply passage 29. In the present embodiment, this problem is resolved in the following manner. Specifically, as illustrated in FIG. 2, an oil transmission passage 63*h* is formed in the coupler 63. The oil transmission passage 63*h* opens in the oil chamber 62*h* of the pump housing 62 and extends toward the center of rotation of the compression mechanism-side shaft 5*s* and the expansion mechanism-side shaft 5*t*. The oil 26 discharged from the pump main unit 61 to the oil chamber 62*h* of the pump housing 62 is allowed to flow through this oil transmission passage 63*h* and is fed into the oil supply passage 29 of the compression mechanism-side shaft 5*s*.

The oil supply passage 29 opens in an end face of the compression mechanism-side shaft 5*s*. The coupler 63 couples the compression mechanism-side shaft 5*s* and the expansion mechanism-side shaft 5*t* to each other in a state where a gap 65 capable of guiding the oil 26 is formed between the compression mechanism-side shaft 5*s* and the expansion mechanism-side shaft 5*t*. The gap 65 is in communication with the oil transmission passage 63*h*. With such a configuration, the oil 26 discharged from the pump main unit 61 is fed into the oil supply passage 29 without interruption even when the coupler 63 is rotated along with the shafts 5*s* and 5*t*. This makes it possible to lubricate the sliding parts of the compression mechanism 2 in a stable manner.

Figure 7:
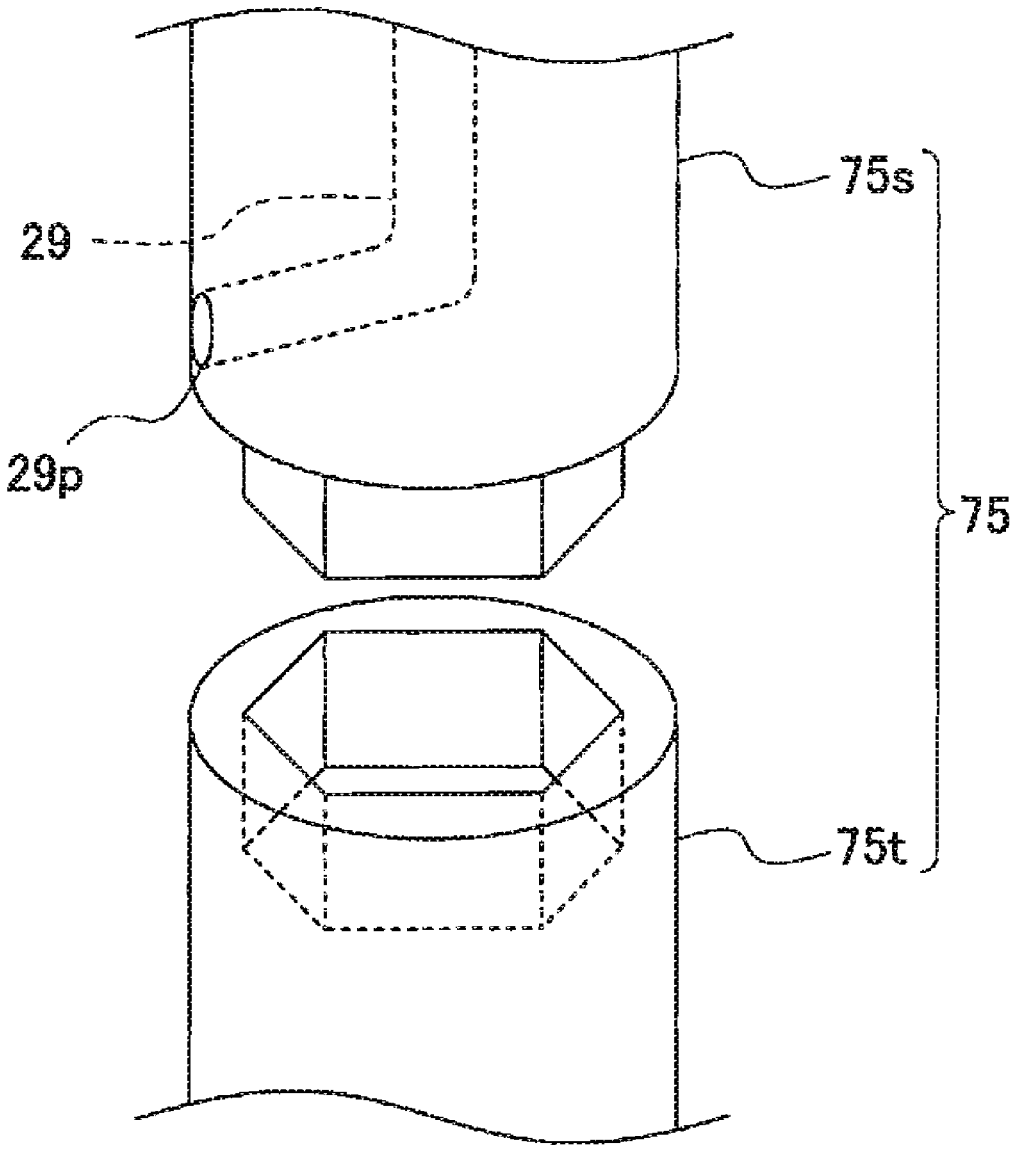
FIG. 7 is a schematic view illustrating another coupling structure of a compression mechanism-side shaft and an expansion mechanism-side shaft.

Furthermore, an embodiment that does not use a coupler is also conceivable. For example, as illustrated in FIG. 7, it is also possible to suitably employ a shaft 75 in which a compression mechanism-side shaft 75*s* and an expansion mechanism-side shaft 75*t* are coupled to each other by male-female coupling. An inlet 29*p* to the oil supply passage 29 formed inside the compression mechanism-side shaft 75*s* is provided on the outer circumferential surface of the compression mechanism-side shaft 75*s*. It is possible to feed the oil 26 discharged from the pump main unit 61 into the oil supply passage 29 by positioning the coupling portion including the inlet 29*p* to the oil supply passage 29 in the oil chamber 62*h* of the pump housing 62. Although such a coupling structure may be inferior to the present embodiment that uses the coupler 63 from the viewpoint of feeding oil to the oil supply passage 29 of the compression mechanism-side shaft 75*s* smoothly, it is possible to reduce the parts count corresponding to the elimination of the coupler 63. It should be noted that although the compression mechanism-side shaft 75*s* has a male part while the expansion mechanism-side shaft 75*t* has a female part in the example shown in FIG. 7, the opposite may also be employed.

Figure 8:
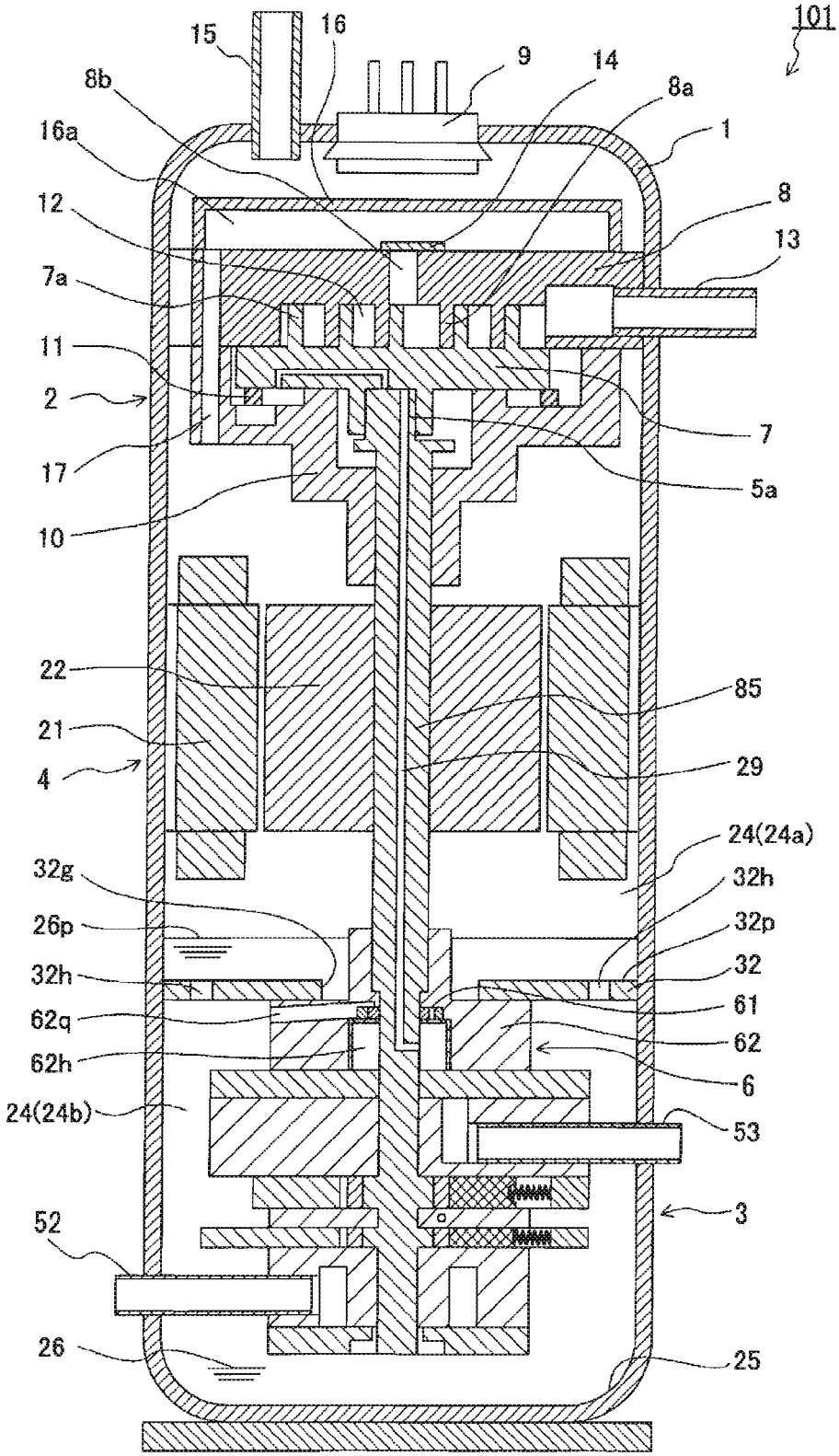
FIG. 8 is a vertical cross-sectional view illustrating another modified example of the expander-compressor unit.

Furthermore, as illustrated in FIG. 8, the coupler 63 is unnecessary also when the compression mechanism 2 and the expansion mechanism 3 are coupled by a single shaft 85. An inlet to the oil supply passage 29 formed inside the shaft 85 opens within the outer circumferential surface of the shaft 85 in the oil chamber 62*h* of the pump housing 62. Accordingly, the oil 26 discharged from the pump main unit 61 is fed smoothly into the oil supply passage 29. An expander-compressor unit 101 shown in FIG. 8 requires adjustment for matching the center of the compression mechanism 2 and the center of the expansion mechanism 3 accurately, but it has a smaller number of parts count than the expander-compressor unit 100 shown in FIG. 1.

Incidentally, one notable feature of the present embodiment shown in FIG. 1 and so forth is that a coupling portion between the compression mechanism-side shaft 5*s* and the expansion mechanism-side shaft 5*t* also serves as an inlet for feeding the oil 26 discharged from the oil pump 6 into the oil supply passage 29.

Figure 17:
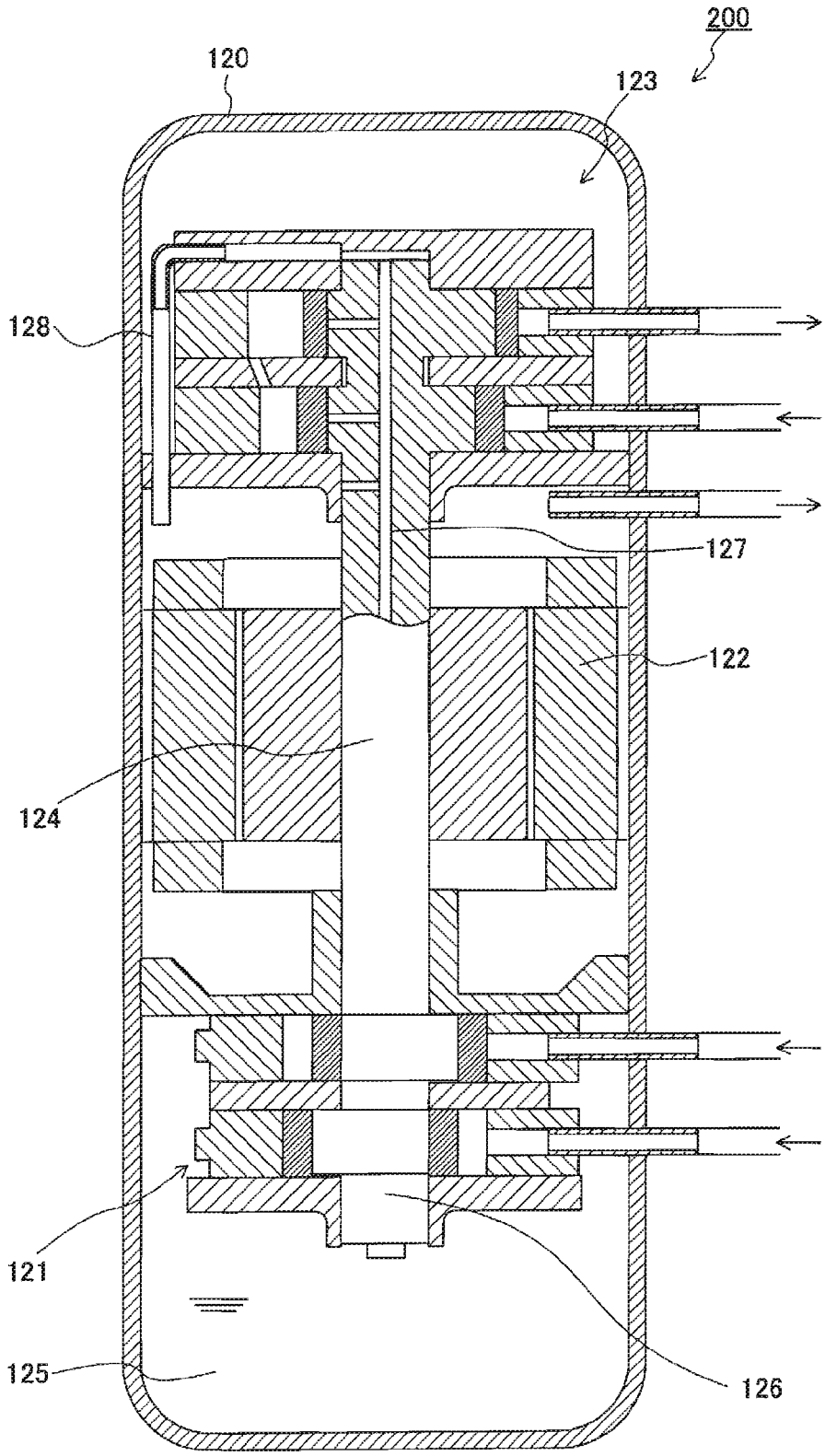
FIG. 17 is a vertical cross-sectional view illustrating a conventional expander-compressor unit.

It already has been discussed that it is preferable to use a single shaft in which the shafts 5*s* and 5*t*, made of a plurality of components, are coupled to each other because, in that way, there is a margin in matching the centers of the compression mechanism 2 and the expansion mechanism 3. However, merely doing so may cause additional adverse effects. The most noticeable adverse effect is oil leakage from the coupling portion. As has been described referring to FIG. 17, the conventional expander-compressor unit has a structure in which oil is pumped up from the lower end of the shaft. Therefore, the coupling portion inevitably is located on the path of the oil supply passage, so there is a possibility of oil leakage from the coupling portion. Such oil leakage hinders efficient oil supply. In contrast, the problem of oil leakage at the coupling portion is essentially non-existent when the coupling portion between the compression mechanism-side shaft 5*s* and the expansion mechanism-side shaft 5*t* is utilized as an inlet to the oil supply passage 29, as in the present embodiment. Therefore, the present embodiment is desirable.

Likewise, the problem of oil leakage at the coupling portion is similarly non-existent when employing a design in which the inlet 29*p* of the oil supply passage 29 is located higher than the coupling portion and the inlet 29*p* is exposed in the oil chamber 62*h*, as illustrated in the modified example shown in FIG. 7. Furthermore, by exposing the coupling portion effected by the male-female coupling in the oil chamber 62*h*, the coupling portion can be lubricated with the oil 26 sufficiently, and therefore, the corners of the shafts 75*s* and 75*t* can be prevented from wearing out. This prevents an increase in vibration that results from excessively large margins.

(Second Embodiment)

Figure 9:
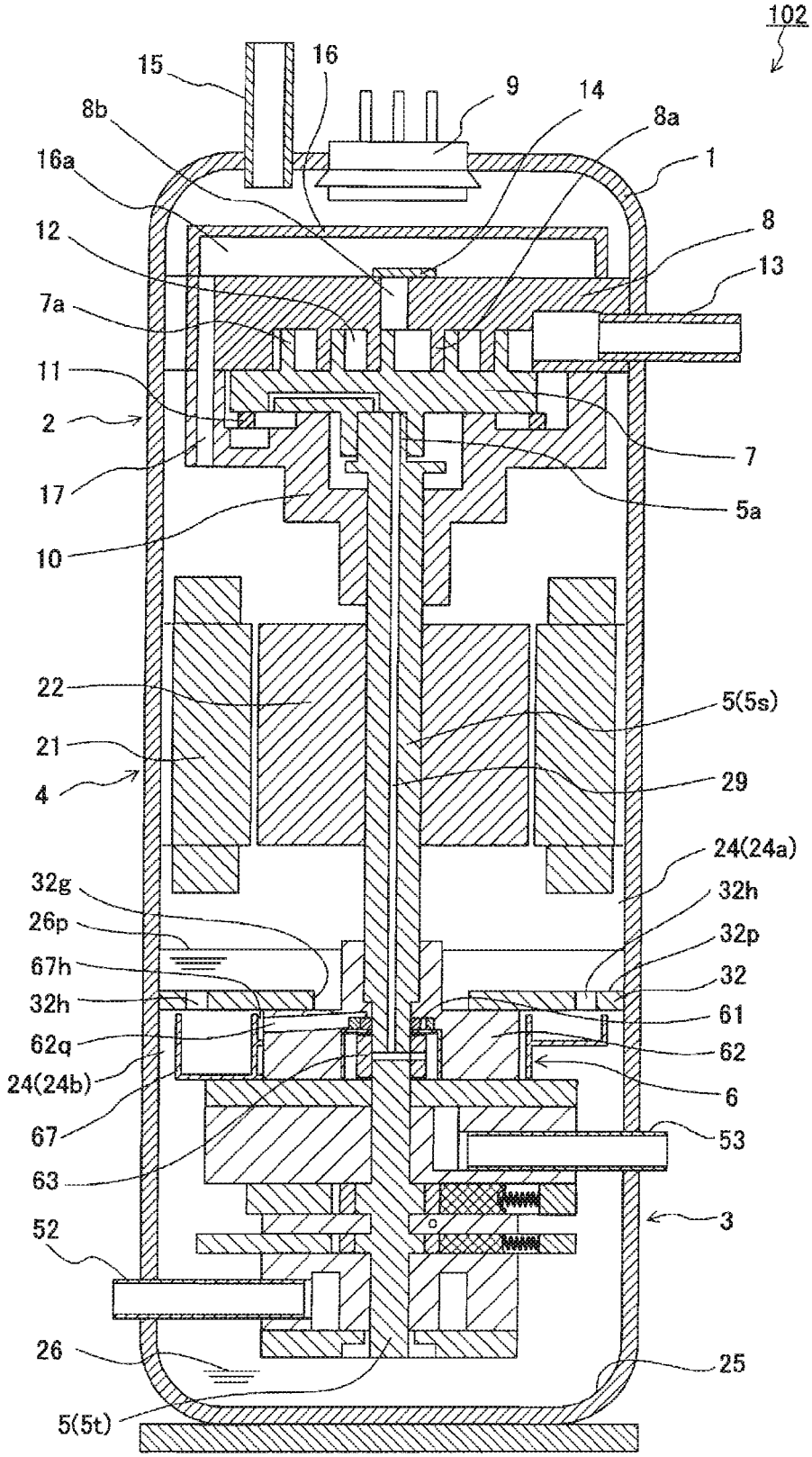
FIG. 9 is a vertical cross-sectional view illustrating an expander-compressor unit according to a second embodiment.
Figure 10:
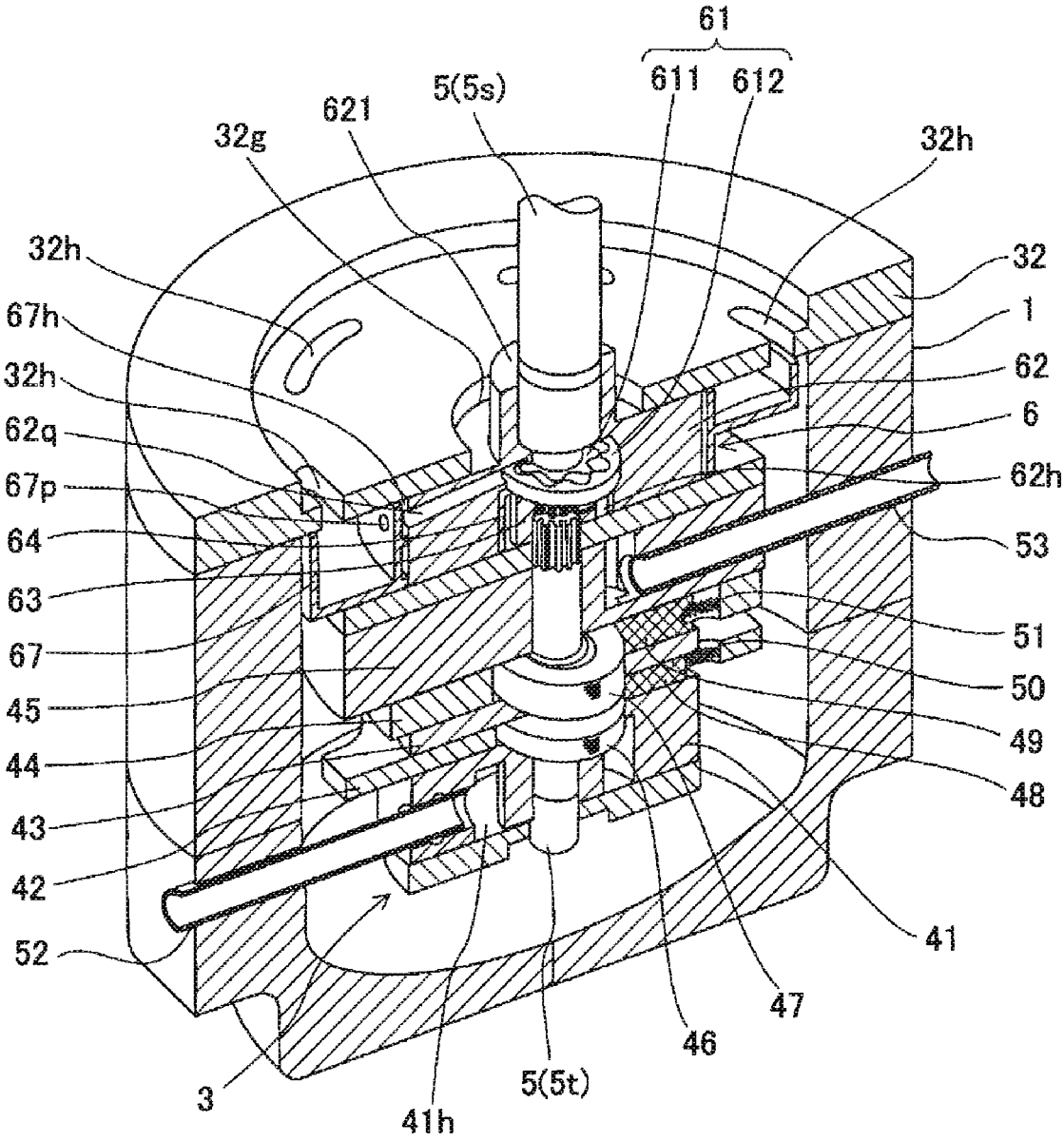
FIG. 10 is a half section perspective view illustrating the expander-compressor unit of FIG. 9.

A vertical cross-sectional view of an expander-compressor unit according to a second embodiment is shown in FIG. 9, and a half section perspective view thereof is shown in FIG. 10. The expander-compressor unit 102 according to the present embodiment differs from the expander-compressor unit 100 according to the first embodiment in that it further has a reserve tank 67. The rest of the parts are common to the two embodiments.

The reserve tank 67 has an annular shape surrounding the oil pump 6 circumferentially. The reserve tank 67 is disposed adjacent to the partition wall 32 in the lower space 24*b*. The reserve tank 67 receives and stores the oil 26 that has travelled from the upper space 24*a* to the lower space 24*b* through the second through holes 32*h* of the partition wall 32. A gap 67*h* is formed between the reserve tank 67 and the oil pump 6 such that the oil 26 stored in the reserve tank 67 flows into the gap. Since the oil suction passage 62*q* opens in the gap 67*h*, the oil pump 6 can draw the oil 26 that flows into the gap 67*h*. Although the reserve tank 67 is adjacent to the partition wall 32, its upper face is not closed by the partition wall 32 completely and a slight gap is formed. Moreover, a gap is also formed between the reserve tank 67 and the closed casing 1. The oil 26 that has overflowed from the reserve tank 67 can be returned to the oil reservoir 25 through these gaps.

Figure 11:
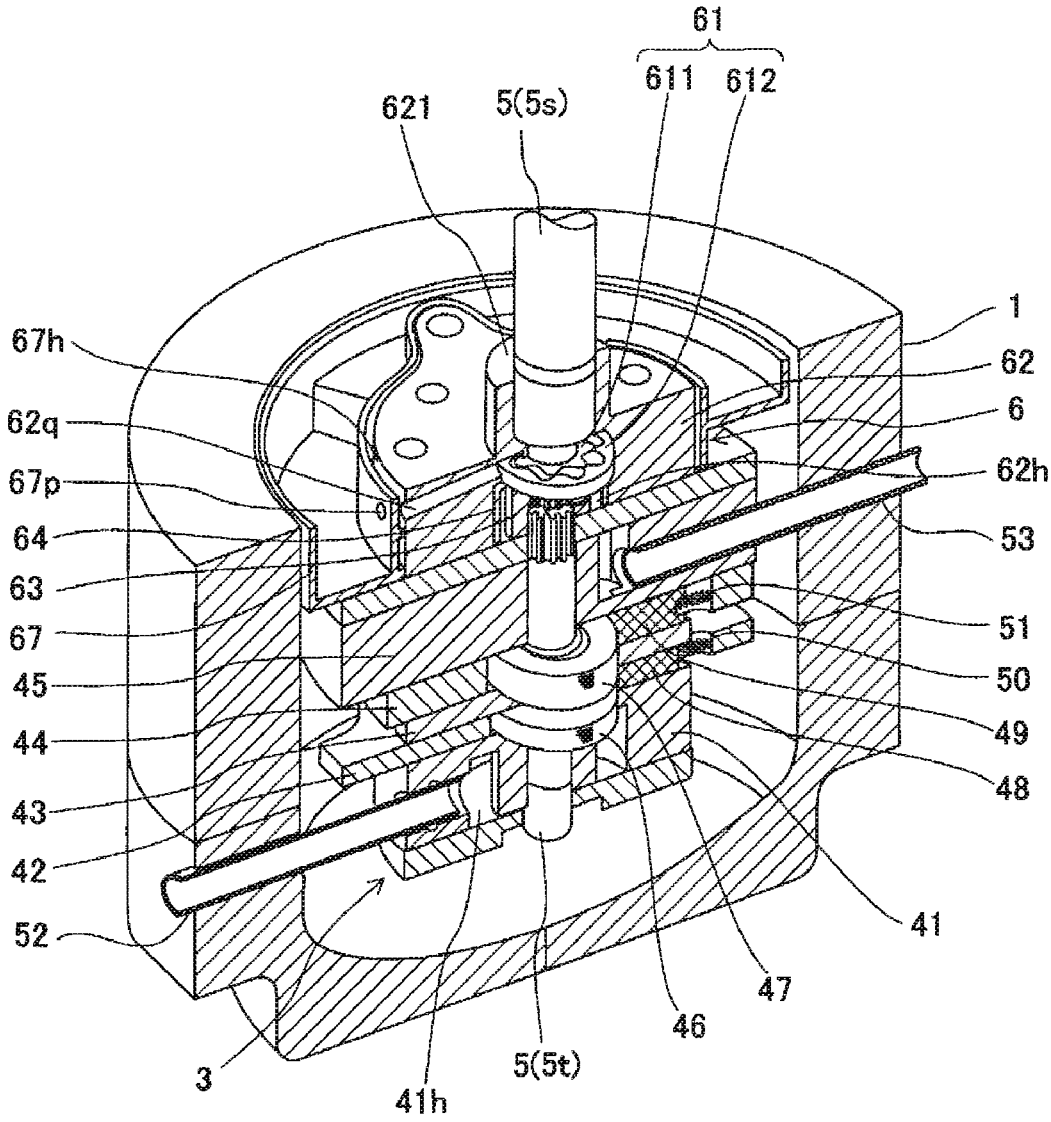
FIG. 11 is an exploded perspective view illustrating the expander-compressor unit shown in FIG. 10 from which the partition wall is removed.

In addition, as illustrated in FIGS. 10 and 11, a hole (or cut-out) 67*p* is formed in a wall of the reserve tank 67 that is on the inner circumferential side, so the oil 26 received by the reserve tank 67 flows into the gap 67*h* through the hole (or cut-out) 67*p*. Instead of forming the hole 67*p* or a cut-out, it is possible to lower the height of the wall on the inner circumferential side to allow the oil 26 that has overflowed the inner circumferential side wall to flow into the gap 67*h*.

Such a reserve tank 67 exerts the thermal insulation effect by restricting the circulation passage of the oil 26. Specifically, the oil 26 that has finished lubricating the compression mechanism 2 first is stored above the partition wall 32. Thereafter, the oil travels from the upper space 24*a* to the lower space 24*b* through the second through holes 32*h*. However, the reserve tank 67 is present also in the lower space 24*b* at which the oil arrives. Therefore, the fraction of the entire oil 26 traveling from the upper space 24*a* to the lower space 24*b* that mixes with the oil 26 remaining in the surrounding space of the expansion mechanism 3 is small, and most of the oil is drawn in the oil pump 6 quickly. As a result, a desirable condition for the refrigeration cycle is produced, in which the oil 26 drawn in the oil pump 6 is at a relatively high temperature while the oil 26 remaining in the surrounding space of the expansion mechanism 3 is at a relatively low temperature.

Moreover, as seen from the exploded perspective view of FIG. 11, the size of the reserve tank 67 with respect to the axis direction of the shaft 5 is adjusted (i.e., the depth is adjusted) so that the depth increases sequentially or step by step toward the location at which the oil suction passage 62*q* opens. With such a configuration, all the oil 26 that falls into the lower space 24*b* through the second through holes 32*h* is stored temporarily in the reserve tank 67 even if a situation arises that the oil level 26*p* drops below the partition wall 32, and a sufficient amount of oil 26 is kept stored in a deep location of the reserve tank 67 for a while. Accordingly, the oil pump 6 can continue to draw the oil 26 even if the oil level 26*p* lowers a little, as long as the oil suction passage 62*q* opens at such a position at which the oil 26 is stored sufficiently. As a result, lubrication deficiency would not occur in the compression mechanism 2 for the time being. Thus, the reserve tank 67 also has the function as a safety net for the case in which the oil level 26*p* drops. The drop of the oil level 26*p* that is assumed is limited to a short period of time. Therefore, the function as a safety net is sufficient as long as proper operation can be ensured for such a period.

It should be noted that examples of the material that constitutes the reserve tank 67 include, but are not particularly limited to, metals, plastics, ceramics, and combinations thereof, as in the case of the partition wall 32.

(Third Embodiment)

Figure 12:
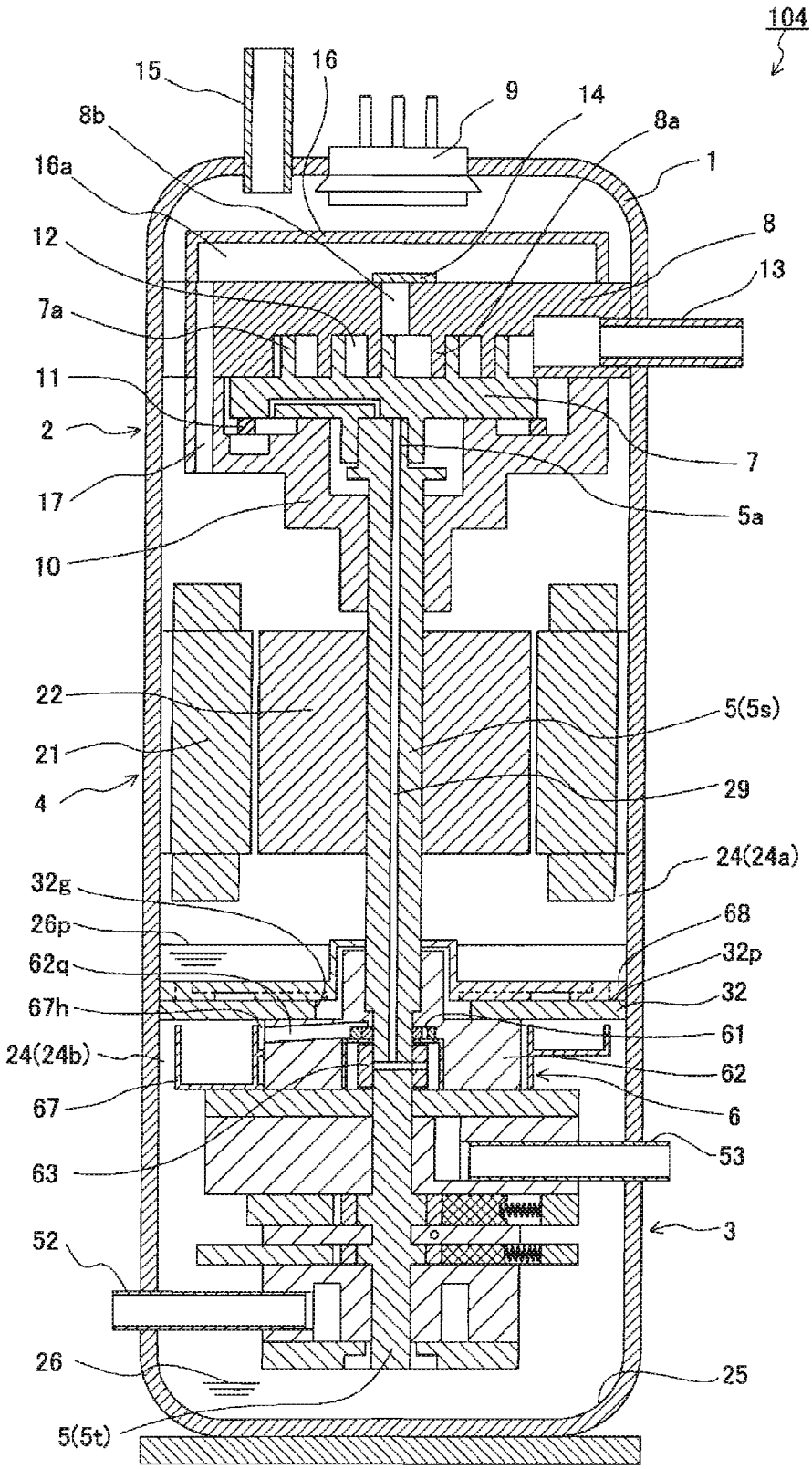
FIG. 12 is a vertical cross-sectional view illustrating an expander-compressor unit according to a third embodiment.

An expander-compressor unit 104 shown in FIG. 12 differs from the expander-compressor unit 102 (see FIG. 9) according to the second embodiment in that it further has a buffer member 68. The rest of the parts are common to the two embodiments.

As illustrated in FIG. 12, the buffer member 68 is disposed between the motor 4 and the partition wall 32. The buffer member reduces turbulence of the oil level 26*p* in association with the rotational driving of the motor 4 to suppress the flow of the oil 26. Therefore, the oil 26 that fills the lower space 24*b* is not easily stirred by the swirling flow caused by the motor 4, so the oil 26 tends to have a temperature gradient along the axis direction easily. As a result, a desirable condition for the refrigeration cycle is produced, in which the oil 26 drawn by the oil pump 6 is at a relatively high temperature while the oil 26 remaining in the surrounding space of the expansion mechanism 3 is at a relatively low temperature.

Figure 13:
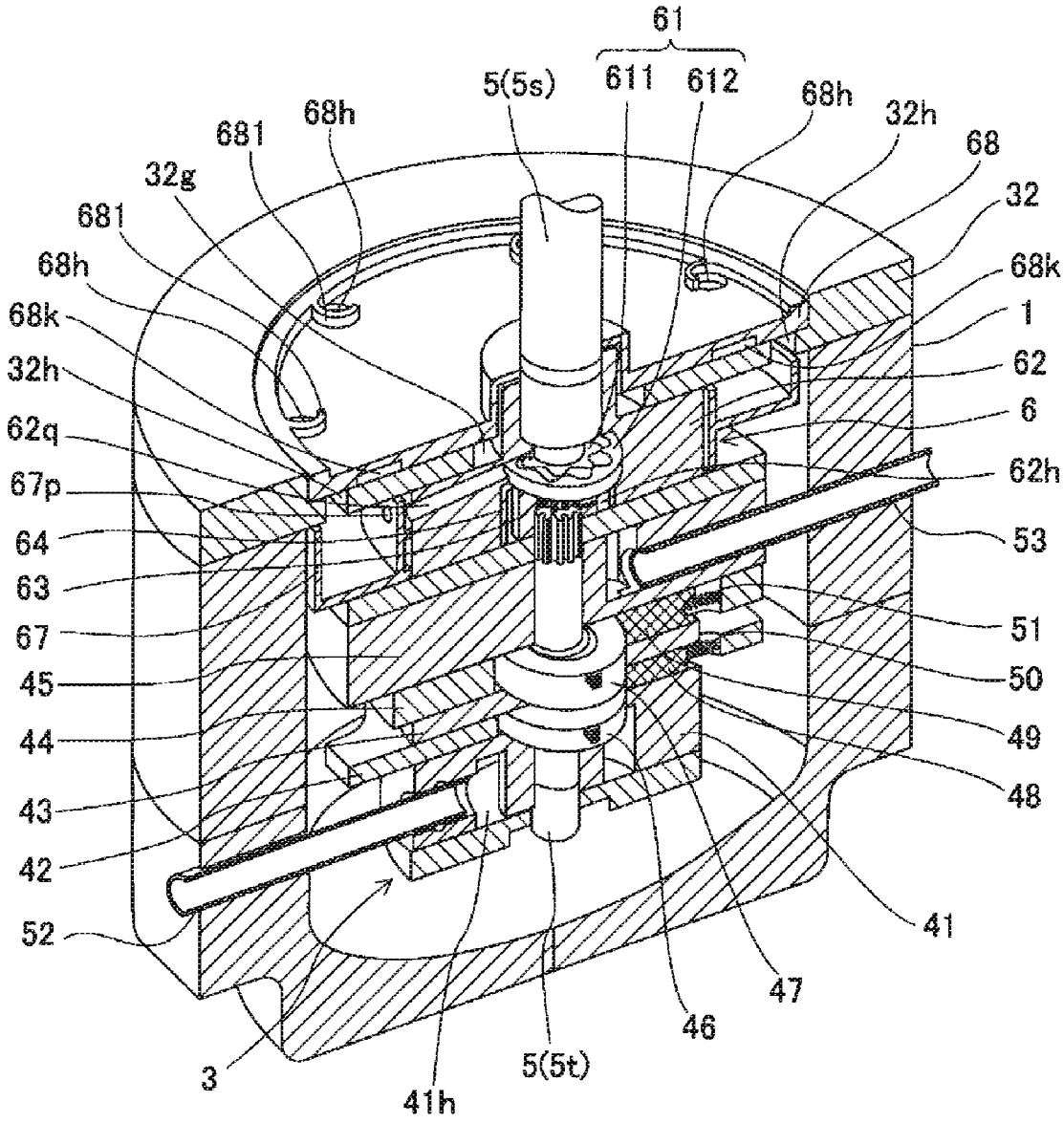
FIG. 13 is a half section perspective view illustrating the expander-compressor unit of FIG. 12.

The buffer member 68 may be made of a member such as a metal mesh or one or a plurality of baffle plates disposed on the upper face 32*p* of the partition wall 32 because it serves the purpose as long it can reduce turbulence of the oil level 26*p*. As illustrated in FIG. 13, the present embodiment uses a circular plate made of a metal, in which through holes 68*h* are formed, like the partition wall 32.

The through holes 68*h* of the buffer member 68 and the through holes 32*h* of the partition wall 32 do not overlap with each other in a plane orthogonal to the axis direction of the shaft 5, so the oil 26 that has flowed into the through holes 68*h* of the buffer member 68 cannot head directly toward the lower space 24*b*. The oil 26 is blocked by the partition wall 32 temporarily, flows over the upper face 32*p* of the partition wall 32, and thereafter travels to the lower space 24*b*.

The flow of the oil 26 will be described in detail. The oil 26 that is above the upper space 24*a* first is guided between the buffer member 68 and the partition wall 32 through the through holes 68*h*. Shallow guide grooves 68*k* extending from the through holes 68*h* toward the shaft 5 are formed in the bottom face side of the buffer member 68. The guide grooves 68*k* are in communication with the first through hole 32*g* of the partition wall 32. The oil 26 flows through the flow passages formed by the upper face 32*p* of the partition wall 32 and the guide grooves 68*k*, and reaches the first through hole 32*g* of the partition wall 32.

Figure 14:
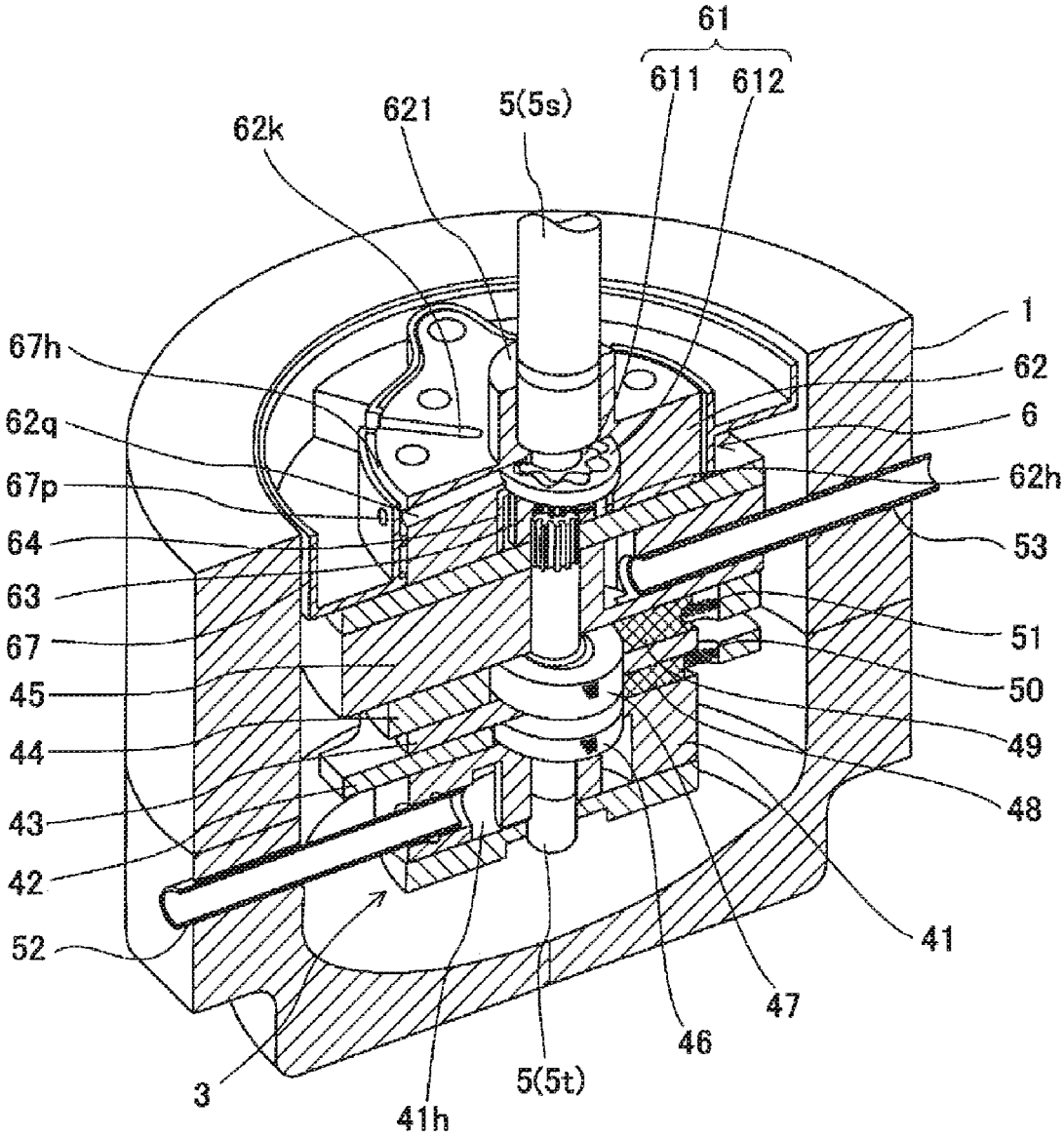
FIG. 14 is an exploded perspective view illustrating the expander-compressor unit shown in FIG. 13 from which a partition wall and a buffer member are removed.

On the other hand, a portion of the pump housing 62 is exposed in the first through hole 32*g*. As illustrated in the half section perspective view of FIG. 14, a groove 62*k* extending outwardly with respect to a radial direction of the shaft 5 is formed in the portion exposed in the first through hole 32*g*. The groove 62*k* communicates with the reserve tank 67 disposed in the surrounding space of the oil pump 6. Thus, the oil 26 that has reached the first through hole 32*g* of the partition wall 32 flows into the first through hole 32*g*, and thereafter, it flows into the reserve tank 67 disposed in the lower space 24*b* via the groove 62*k* formed in the pump housing 62. This means that a communication passage for communicating the upper space 24*a* and the lower space 24*b* with each other is formed by the first through hole 32*g* and the groove 62*k* of the pump housing 62. The turbulence of the oil level 26*p* originating from the rotational driving of the motor 4 is reduced by causing the oil 26 to flow along a radial direction and/or a circumferential direction of the shaft 5 and thereafter to move it to the lower space 24*b*. Such a flow passage of the oil 26 more strongly hinders the stirring effect by the motor 4 from transmitting to the oil 26 in the lower space 24*b*.

As illustrated in FIG. 13, the buffer member 68 has collars 681 provided around the openings of the through holes 68*h*. The collars 681 hinder the oil 26 from flowing around smoothly (clockwise in the example shown in FIG. 13) along the upper face of the buffer member 68 because of the influence from the motor 4, and thereby reduces the flow velocity of the oil 26 flowing into the through holes 68*h*.

The shallow guide grooves 68*k* formed in the buffer member 68 may be formed on the partition wall 32 side. The buffer member 68 does not need to be in contact with the partition wall 32. For example, the buffer member 68 may be disposed parallel to the partition wall 32 so that a layer of the oil 26 can be formed between it and the partition wall 32.

Moreover, it is possible to configure both the buffer member 68 and the partition wall 32 as one structural body. In other words, it is possible to allow the partition wall 32 to serve the role of the buffer member 68 also. Such a partition wall may be configured to include a buffer structure that reduces turbulence of the oil level 26*p* in association with the rotational drive of the motor 4 by introducing the oil 26 lying in the upper space 24*a* into a communication passage formed therein, causing it to flow along a radial direction and/or a circumferential direction of the shaft 5, and thereafter moving it to the lower space 24*b*.

(Fourth Embodiment)

Figure 15:
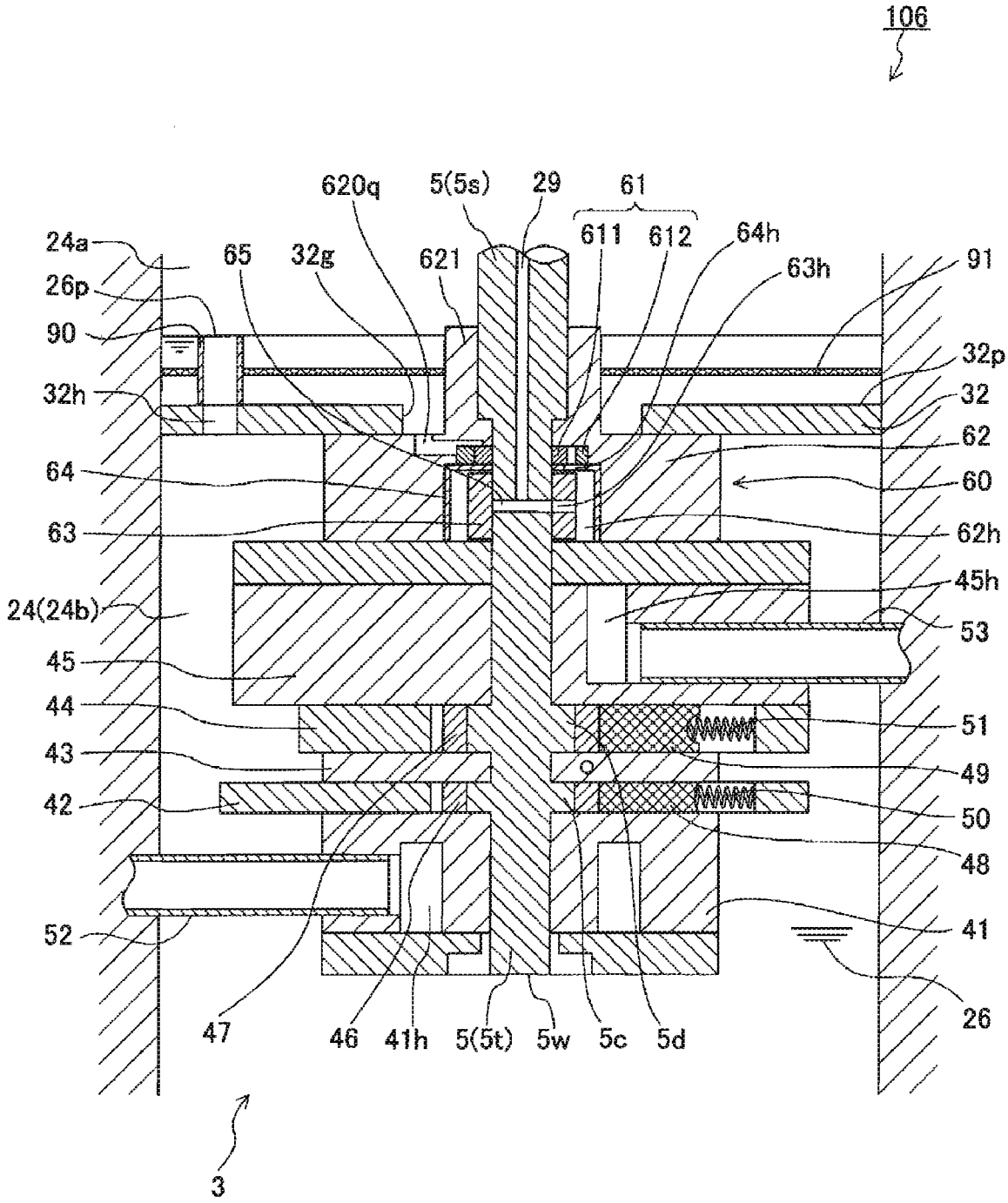
FIG. 15 is a partially-enlarged cross-sectional view illustrating an expander-compressor unit according to a fourth embodiment.

In the expander-compressor units according to the first to third embodiments, the oil suction passage 62*q* opens in the lower space 24*b*, but this not essential. Specifically, as illustrated in FIG. 15, the pump main unit 61 is allowed to draw the oil 26 stored above the upper face 32*p* of the partition wall 32 directly.

The partition wall 32 is what has already been described in the first embodiment, in which the first through hole 32*g* for allowing the shaft 5 to penetrate therethrough is formed at the center, and the second through holes 32*h* for permitting the oil 26 to flow between the upper space 24*a* and the lower space 24*b* are formed in the peripheral portion. Additionally, overflow pipes 90 are attached to the second through holes 32*h* so that a predetermined amount of oil 26 can be held using the upper face 32*p* of the partition wall 32 as the bottom face. The oil 26 stored above the partition wall 32 can travel to the lower space 24*b* only by flowing into the overflow pipes 90. In addition, a buffer member 91 for reducing turbulence of the oil level 26*p* is disposed between the upper face 32*p* of the partition wall 32 and upper ends of the overflow pipes 90. A layer of the oil 26 whose flow is suppressed is formed between the buffer member 91 and the partition wall 32. The buffer member 91 is made of a plate material or a mesh material in which through holes for permitting the oil 26 to flow therethrough are formed.

On the other hand, an oil suction passage 620*q*, one end of which forms the suction port 61*a* of the pump main unit 61 (see FIG. 15) while the other end of which opens in the upper space 24*a*, is formed in the pump housing 62 of an oil pump 60. Since the oil suction passage 620*q* opens in the first through hole 32*g* of the partition wall 32, the pump main unit 61 can draw only the oil 26 that is stored above the partition wall 32. It should be noted that another through hole may be formed separately in the partition wall 32, and the through hole and the oil suction passage 620*q* may be allowed to communicate with each other so that the pump main unit 61 can draw the oil 26 in the upper space 24*a*.

Thus, it is made possible to hold the oil 26 above the partition wall 32 because of the working of the overflow pipes 90, and the combination of the partition wall 32 and the overflow pipes 90 serves the role such as the reserve tank as described in the second embodiment. The oil level 26*p* is located slightly higher than the upper ends of the overflow pipes 90 during the normal operation of the heat pump apparatus. Even if the oil level 26*p* drops temporarily, a sufficient amount of oil 26 is held above the partition wall 32. Therefore, the oil pump 60 can continue to draw the oil 26 for the time being.

Figure 16:
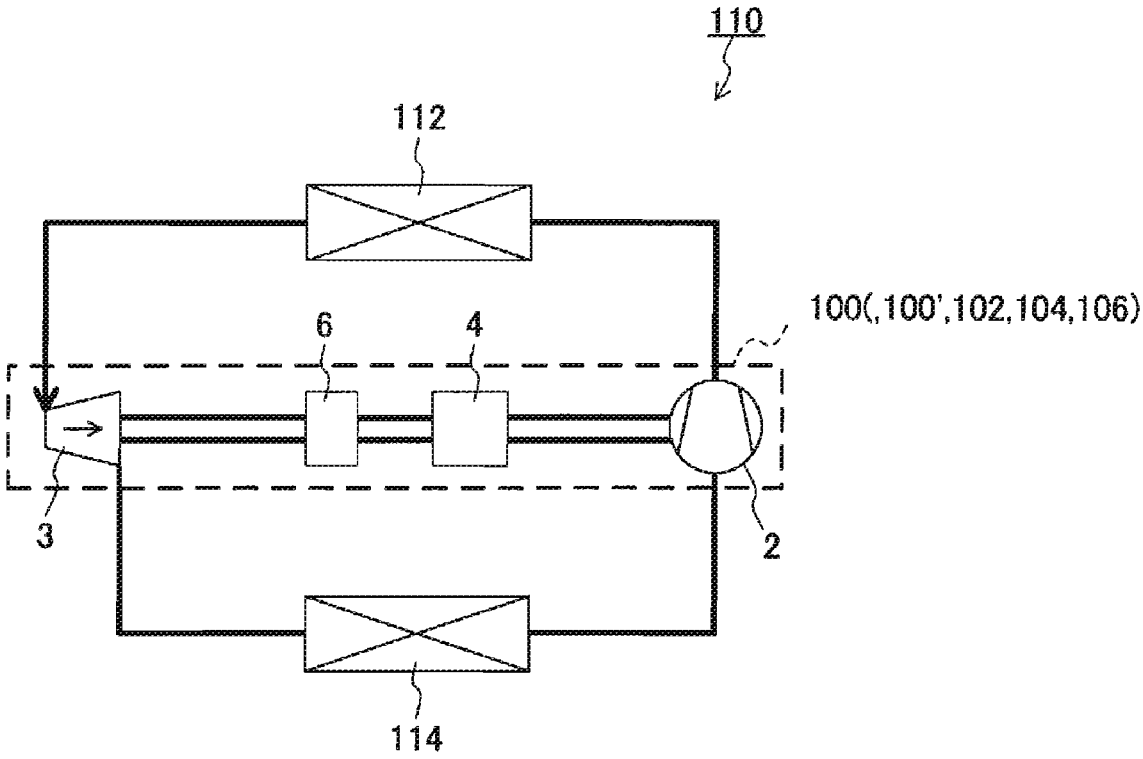
FIG. 16 is a block diagram of a heat pump apparatus employing an expander-compressor unit according to the present invention.

Thus, the expander-compressor unit according to the present invention suitably may be applied to, for example, heat pump apparatuses for air conditioners, water heaters, various driers, and refrigerator-freezers. As illustrated in FIG. 16, a heat pump apparatus 110 includes: an expander-compressor unit 100, (101, 102, 104, or 106) according to the present invention; a radiator 112 for cooling the refrigerant compressed by the compression mechanism 2; and an evaporator 114 for evaporating the refrigerant expanded by the expansion mechanism 3. The compression mechanism 2, the radiator 112, the expansion mechanism 3, and the evaporator 114 are connected by pipes, whereby a refrigerant circuit is formed.

The invention claimed is:

1. An expander-compressor unit comprising:

a closed casing having a bottom portion utilized as an oil reservoir;

a compression mechanism disposed in the closed casing so as to be located either higher or lower than an oil level of oil held in the oil reservoir;

an expansion mechanism disposed in the closed casing either higher or lower than the oil level so that the position of the expansion mechanism relative to the oil level is vertically opposite to that of the compression mechanism;

a shaft for coupling the compression mechanism and the expansion mechanism to each other; and an oil pump, disposed between the compression mechanism and the expansion mechanism relative to an axis direction of the shaft, for supplying the oil filling a surrounding space of the compression mechanism or the expansion mechanism to the one of the compression mechanism or the expansion mechanism that is located higher than the oil level.

2. The expander-compressor unit according to claim 1, further comprising:

a motor, disposed between the compression mechanism and the expansion mechanism, for rotationally driving the shaft; and wherein:

the oil pump is disposed between the motor and the compression mechanism or between the motor and the expansion mechanism; and the oil is held in the closed casing in an amount such that a rotor of the motor is located higher than the oil level.

3. The expander-compressor unit according to claim 1, wherein: an oil supply passage is formed inside the shaft so as to extend in the axis direction, the oil supply passage communicating with sliding parts of one of the compression mechanism and the expansion mechanism that is located higher than the oil level; and the oil discharged from the oil pump is fed into the oil supply passage.

4. The expander-compressor unit according to claim 3, wherein:

the oil pump comprises a pump main unit configured to pump oil by an increase/decrease of a volumetric capacity of a working chamber in accordance with rotation of the shaft, and a pump housing disposed adjacent to the pump main unit and having an oil chamber formed therein for temporarily accommodating the oil discharged from the pump main unit; and the shaft is exposed in the oil chamber of the pump housing so that the oil discharged from the pump main unit is fed into the oil supply passage formed inside the shaft.

5. The expander-compressor unit according to claim 4, wherein the pump main unit is a rotary type comprising an inner rotor attached to the shaft and an outer rotor forming the working chamber between it and the inner rotor.

6. The expander-compressor unit according to claim 4, wherein:

the pump housing comprises an inner wall portion for partitioning the oil chamber and a space in which the pump main unit is disposed, along the axis direction of the shaft; and a communication port is formed in the inner wall portion, one end of the communication port forming a discharge port of the pump main unit and the other end of the communication port opening in the oil chamber.

7. The expander-compressor unit according to claim 4, wherein the shaft comprises a compression mechanism-side shaft connected to the compression mechanism and an expansion mechanism-side shaft connected to the expansion mechanism, and the compression mechanism-side shaft and the expansion mechanism-side shaft are coupled to each other in the oil chamber of the pump housing.

8. The expander-compressor unit according to claim 7, further comprising a coupler, disposed in the oil chamber of the pump housing, for coupling the compression mechanism-side shaft and the expansion mechanism-side shaft to each other.

9. The expander-compressor unit according to claim 8, wherein an oil transmission passage is formed in the coupler, the oil transmission passage opening to the oil chamber of the pump housing and extending toward the center of rotation of the compression mechanism-side shaft and the expansion mechanism-side shaft, and the oil discharged from the pump main unit to the oil chamber of the pump housing flows through the oil transmission passage and is fed into the oil supply passage.

10. The expander-compressor unit according to claim 9, wherein:

the oil supply passage opens in an end face of the compression mechanism-side shaft or an end face of the expansion mechanism-side shaft; and the coupler couples the compression mechanism-side shaft and the expansion mechanism-side shaft to each other in a state where a gap capable of guiding oil is formed between the compression mechanism-side shaft and the expansion mechanism-side shaft, the gap being in communication with the oil transmission passage.

11. The expander-compressor unit according to claim 1, further comprising a partition wall for partitioning an internal space of the closed casing into an upper space in which one selected from the compression mechanism and the expansion mechanism is disposed and a lower space in which the other one is disposed, along the axis direction of the shaft, the partition wall having a communication passage formed therein for allowing the upper space and the lower space to communicate with each other so that the oil is permitted to travel between the upper space and the lower space.

12. The expander-compressor unit according to claim 11, wherein:

an oil suction passage of the oil pump opens in the lower space; and further comprising:

a reserve tank, disposed in the lower space, for receiving and storing the oil that has travelled to the lower space through the communication passage of the partition wall, so that the oil pump can draw the stored oil through the oil suction passage.

13. The expander-compressor unit according to claim 11, wherein the oil suction passage of the oil pump opens in the upper space, and the oil held higher than the partition wall is drawn by the oil pump.

14. The expander-compressor unit according to claim 1, wherein one of the compression mechanism and the expansion mechanism that is immersed directly in the oil is a rotary type mechanism; the shaft penetrates the rotary type mechanism in the axis direction; and a groove is formed in an outer circumferential surface of the shaft so as to extend from its lower end toward sliding parts of the rotary type mechanism.

15. The expander-compressor unit according to claim 1, further comprising a second oil pump for supplying the oil to sliding parts of one of the compression mechanism and the expansion mechanism that is immersed directly in the oil.

16. The expander-compressor unit according to claim 2, wherein:

the compression mechanism is a scroll-type mechanism and the expansion mechanism is a rotary type mechanism; and the compression mechanism, the motor, the oil pump, and the expansion mechanism are disposed in that order along the axis direction of the shaft so that the expansion mechanism is immersed directly in the oil of the oil reservoir.

17. An expander-compressor unit comprising:

a closed casing;

a compression mechanism disposed in the closed casing;

an expansion mechanism disposed in the closed casing;

a shaft for coupling the compression mechanism and the expansion mechanism to each other;

a partition wall, for partitioning an internal space of the closed casing into an upper space in which one selected from the compression mechanism and the expansion mechanism is disposed and a lower space in which the other one is disposed, along an axis direction of the shaft, the partition wall having a communication passage formed therein for allowing the upper space and the lower space to communicate with each other so that the oil held in the closed casing for lubricating the compression mechanism and the expansion mechanism is permitted to travel between the upper space and the lower space; and an oil pump, disposed between the compression mechanism and the expansion mechanism, for pumping up and supplying the oil to one of the compression mechanism and the expansion mechanism that is located in the upper space.

18. The expander-compressor unit according to claim 17, wherein the oil is held in the closed casing in an amount necessary for an oil level to be located higher than the partition wall.

19. The expander-compressor unit according to claim 17, wherein: an oil supply passage is formed inside the shaft so as to extend in the axis direction, the oil supply passage communicating with sliding parts of one of the compression mechanism and the expansion mechanism that is located in the upper space; and the oil discharged from the oil pump is fed into the oil supply passage.

20. The expander-compressor unit according to claim 19, wherein:

the oil pump comprises a pump main unit configured to pump oil by an increase/decrease of a volumetric capacity of a working chamber in accordance with rotation of the shaft, and a pump housing disposed adjacent to the pump main unit and having an oil chamber formed therein for temporarily accommodating the oil discharged from the pump main unit; and the shaft is exposed in the oil chamber of the pump housing so that the oil discharged from the pump main unit is fed into the oil supply passage formed inside the shaft.

21. The expander-compressor unit according to claim 20, wherein:

the pump housing comprises an inner wall portion for partitioning the oil chamber and a space in which the pump main unit is disposed, along the axis direction of the shaft; and a communication port is formed in the inner wall portion, one end of the communication port forming a discharge port of the pump main unit and the other end of the communication port opening in the oil chamber.

22. The expander-compressor unit according to claim 20, wherein an oil suction passage opening in the upper space or the lower space is formed in the pump housing so as to extend from an outer circumferential surface of the pump housing toward a space in which the pump main unit is accommodated.

23. The expander-compressor unit according to claim 22, further comprising a reserve tank, disposed in the lower space, for receiving and storing the oil that has travelled to the lower space through the communication passage of the partition wall, so that the oil pump can draw the stored oil through the oil suction passage.

24. The expander-compressor unit according to claim 17, further comprising:

a motor, disposed between the compression mechanism and the expansion mechanism, for rotationally driving the shaft; and a buffer member, disposed between the motor and the partition wall, for reducing turbulence of an oil level associated with the rotational driving of the motor.

25. The expander-compressor unit according to claim 17, further comprising a motor, disposed between the compression mechanism and the expansion mechanism, for rotationally driving the shaft; and wherein:

one of the compression mechanism and the expansion mechanism is disposed the upper space together with the motor and the other one is disposed in the lower space together with the oil pump; and the partition wall comprises a buffer structure for reducing turbulence of an oil level in association with the rotational driving of the motor by introducing the oil lying in the upper space into the communication passage, causing the oil to flow along a radial direction and/or a circumferential direction of the shaft, and thereafter moving the oil to the lower space.

26. The expander-compressor unit according to claim 17, wherein one of the compression mechanism and the expansion mechanism that is disposed in the lower space is a rotary type mechanism; the shaft penetrates the rotary type mechanism in the axis direction; and a groove is formed in an outer circumferential surface of the shaft so as to extend from its lower end toward sliding parts of the rotary type mechanism.

27. The expander-compressor unit according to claim 17, further comprising a second oil pump for supplying the oil to sliding parts of one of the compression mechanism and the expansion mechanism that is disposed in the lower space.

28. The expander-compressor unit according to claim 17, wherein:

the compression mechanism is a scroll-type mechanism and the expansion mechanism is a rotary type mechanism; and the compression mechanism, the oil pump, and the expansion mechanism are disposed in that order along the axis direction of the shaft so that the expansion mechanism is immersed directly in the oil.

* * * * *